United States Patent [19]

Nobuta et al.

[11] Patent Number: 4,772,003

[45] Date of Patent: Sep. 20, 1988

[54] APPARATUS FOR STACKING SIGNATURES OR THE LIKE

[75] Inventors: Yosuke Nobuta; Touri Takahashi, both of Yokohama; Junzo Nagashima, Machida; Kazuo Yoshida, Tokyo; Masao Yamanaka, Tokyo, all of Japan

[73] Assignees: Dainihon Insatsu Kabushiki Kaisha; Kabushiki Kaisha Tokyo Kikai Seisakusho, both of Tokyo, Japan

[21] Appl. No.: 18,341

[22] Filed: Feb. 24, 1987

[51] Int. Cl.[4] ..... B65H 39/02

[52] U.S. Cl. ..... 270/58; 414/43; 414/45; 414/98; 414/108; 271/181; 198/423

[58] Field of Search ..... 270/54, 58; 414/32, 414/35, 41–43, 45, 46, 50, 76, 79, 69, 98, 103, 108; 271/181, 214, 259, 218; 198/422, 423

[56] References Cited

U.S. PATENT DOCUMENTS

| | | | |
|---|---|---|---|
| 2,776,831 | 1/1957 | Shields | 414/46 |
| 3,194,127 | 7/1965 | Larsson | 414/43 |
| 3,772,971 | 11/1973 | Dutro et al. | 414/43 |
| 3,772,972 | 11/1973 | Dutro et al. | 414/46 |
| 3,822,793 | 7/1974 | Stobb | 414/98 |
| 3,927,777 | 12/1975 | Newell | 271/181 |
| 3,932,982 | 1/1976 | Klapp | 414/103 |
| 4,058,226 | 11/1977 | Peters, Jr. | 198/422 |
| 4,172,531 | 10/1979 | Müller | 414/108 |
| 4,302,198 | 11/1981 | Kawada | 270/58 X |
| 4,541,763 | 9/1985 | Chandhoue et al. | 414/45 |
| 4,725,180 | 2/1988 | Kasamatsu et al. | 414/35 |

FOREIGN PATENT DOCUMENTS

| | | |
|---|---|---|
| 58-7586 | 2/1983 | Japan . |
| 59-135192 | 8/1984 | Japan . |

*Primary Examiner*—E. H. Eickholt

*Attorney, Agent, or Firm*—Trexler, Bushnell, Giangiorgi & Blackstone, Ltd.

[57] ABSTRACT

An apparatus for stacking signatures or the like includes a guide plate having a predetermined angle of inclination and a conveyor for successively loading signatures onto the upper end of the guide plate from the upper side of the latter. The foremost end of a stack of signatures which are being stacked on the guide plate is supported by a first support member which gradually lowers through a section from the signature loading position to an intermediary position, and is then supported by a second support member through a section from the intermediary position to an unloading position. The rearmost end of the stack of signatures is supported by a third support member through the entire section from the loading position to the unloading position. For this purpose, the first, second and third support members are repeatedly moved along the guide plate in relation to each other. Also disclosed are techniques accompanying the signature stacking technique, that is, means for pressing a signature at the loading section, means for forming a stack of signatures, auxiliary means for forming a stack of signatures and means for attaching a panel to each of the front and rear ends of a stack of signatures.

22 Claims, 15 Drawing Sheets

12
13
14
16
17
18
50
53
54
55
59
60
61
62
63
64
65
66
67
68
69
70
71
72
73
74

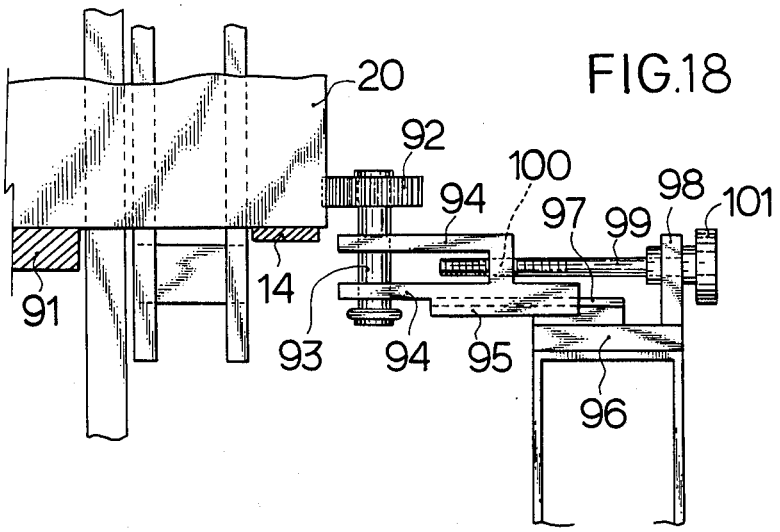
FIG.18
FIG.19
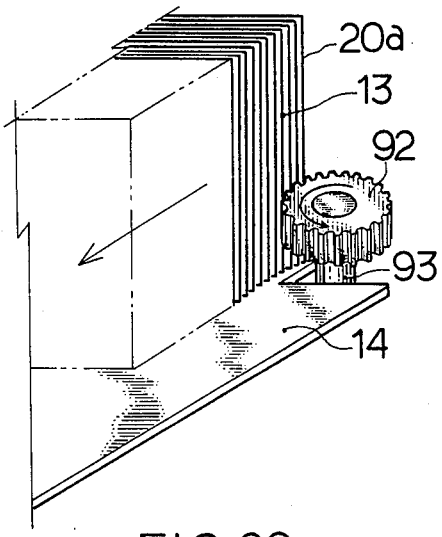
FIG.21
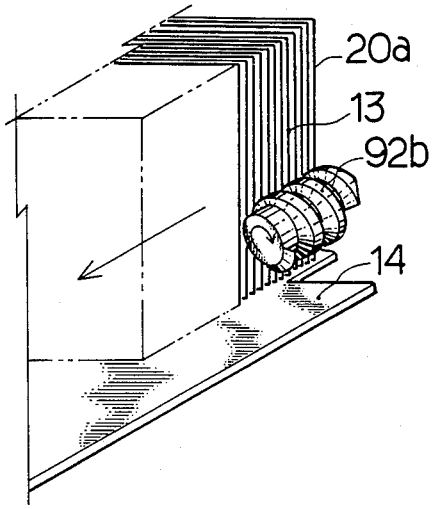
FIG.20
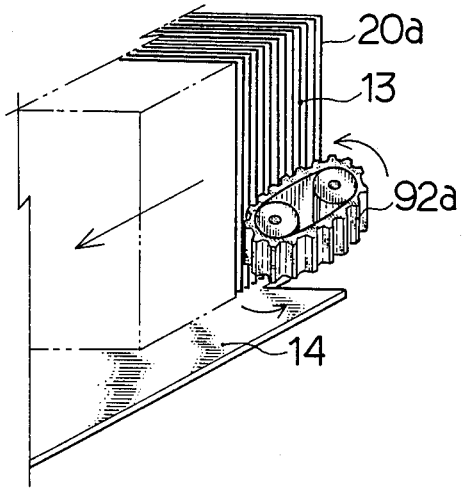
FIG.22
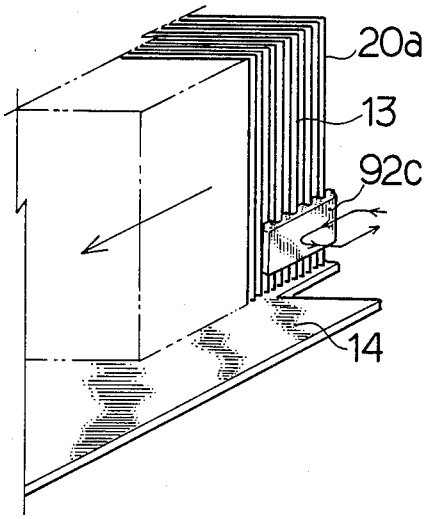

APPARATUS FOR STACKING SIGNATURES OR THE LIKE

BACKGROUND OF THE INVENTION a. Field of the Invention

The present invention relates to an apparatus for converting a stream of signatures, which have been completed with printing and folding and discharged in such a manner that the signatures overlap one another at a predetermined pitch, into divisions each consisting of a predetermined number of signatures as a preliminary step for transporting signatures to a bookbinding step. More particularly, the present invention relates to a signature stacking apparatus of the conversion type in which signatures are vertically loaded onto a guide plate one by one and stacked thereon substantially horizontally. More specifically, the present invention pertains to a signature stacking apparatus including stacking of signatures and techniques accompanying it, that is, means for pressing a signature at a loading section, means for forming a stack of signature, auxiliary means for forming a stack of signatures and means for attaching a panel to each of the front and rear ends of a stack of signatures.

b. Prior Art

There have heretofore been two types of signature stacking method. In one type of conventional method, signatures are loaded vertically and stacked horizontally; in the other type, signatures are loaded horizontally and stacked vertically. The former method has the advantage that the weight of each of the stacked signatures is not loaded on others and it is possible to smoothly and regularly stack signatures on a guide plate by making use of the weight of each signature, but, at the same time, involves the disadvantage that, when each signature consists of a relatively small number of pages or when paper is relatively thin and hence limp, it may be difficult to stand them alone and they may buckle easily to come out of exact register with each other. The former method includes three types of manner of loading signatures onto a stacking section, that is, upward loading, downward loading and gravity-drop loading. In the case of upward loading, since the entire weight of stacked signatures is loaded on a signature loaded thereunder, when the number of stacked signatures is relatively small, there may be irregularities in alignment of signatures, and as the number of stacked signatures increases, various problems may occur, such as folding of edges of signatures and generation of folding marks or scuff marks. In the case of downward loading, a change in the number of stacked signatures leads to a change in the total thickness of the folded sides of signatures, and as the number of stacked signatures increases, the upper surface of the stack of signatures slants to lead to an undesirable slide of stacked signatures. If the number of stacked signatures is limited to a relatively small value in order to prevent such problem, each bale of signatures becomes disadvantageously small and the number of bales increases, resulting in an increase in the amount of consumption of tying bands. In the case of gravity-drop loading, signatures cannot stably be loaded and therefore cannot be stacked regularily. As the operation speed is increased, the degree of irregularity in alignment of signatures becomes considerably high, so that problems such as folding of edges of signatures and generation of folding marks are readily caused.

The applicant of this application has already developed a guide plate described below and filed an application. Namely, as shown in the specification of Japanese Patent Laid-Open No. 135192/1984, a curved guide plate is provided halfway the signature transport path at a position where the path changes from a slanting transport section to a horizontal transport section, in order to cope with a difference in terms of thickness between the upper and lower sides of signatures which results from the fact that signatures to be stacked are arranged with the folded side thereof directed downward and the cut side thereof directed upward.

However, it has been found as the result of many experiments that, although smooth stacking is achieved when the curvature of a stack of signatures, which is formed due to a difference in terms of thickness between the upper and lower sides of the stack, is equal to or greater than that of the curved guide plate, in the case of stacking signatures which have a relatively small difference in terms of thickness between the upper and lower sides thereof and in which, therefore, the above-described former curvature is smaller than the latter curvature, the respective upper portions of the signatures may come into close contact with each other to cause their lower portions to be lifted from the guide plate, and the apparatus therefore lacks general-purpose property although it is excellent as a special purpose machine.

All signatures which are successively loaded onto a stacking section have already been folded, particularly folded double. If the folding angle is obtuse, the stacking density becomes low, which means that the stack of such signatures occupies a relatively large area and is difficult to handle. For this reason, it is preferable that each of the signatures which are to be stacked should be strongly and sharply folded along the folding line, and if signatures are folded sharply, the stacking density can readily be increased.

Japanese Patent Publication No. 7586/1983 teaches that a signature is passed through the area between a pair of pressure rollers which are in uniform contact with each other, thereby uniformly and strongly forming a fold line, and thus reducing the thickness of the signature.

However, the bookbinding step includes a so-called saddle stitching operation in which staple-type stitching wires are driven into signatures along the above-described fold line and two axial end portions of each stitching wire are bent inwardly. In this stitching operation, if the folding angle is exceedingly acute, a cut may be generated along the fold line of the stitched portion, resulting in a reduction in the stitching effectiveness.

Therefore, it is desired to develop a signature pressing means which enables formation of an acute folding angle to increase the stacking density and yet involves no fear of the stitched portion being cut by saddle stitching wires driven thereinto and thus provides improved stitching effectiveness.

Since signatures are loaded onto a plane at a constant position at all times, it is necessary, in order to allow signatures to be smoothly stacked, to enable the whole of the stack of signatures, together with a front retainer, to move forward by a distance corresponding to the thickness of each signature every time a succeeding signature is loaded, thereby providing room for receiving the succeeding signature at the rear end of the growing stack of signatures at all times.

The specification of Japanese Patent Publication No. 7586/1983 discloses a simple structure wherein a stack of signatures is placed on a table and the forward end of the stack is supported by a front retaining weight. This structure, however, provides no room for smoothly receiving a succeeding signature onto the table, and the succeeding signature is forced into the rear end portion of the stack of signatures, thereby transmitting the pressure produced by the insertion of the signature to the front retaining weight on the table, and thus advancing the weight. Accordingly, relatively high frictional resistance occurs, and this prevents an amount of displacement equal to the thickness of the loaded signature from being reliably and accurately transmitted to the weight, resulting in an extreme increase in the internal pressure of the stack itself. Such high internal pressure prevents smooth loading of a new signature and increases the level of friction occurring when a succeeding signature is loaded, which leads to damage to the printed surface, and a signature which is relatively limp cannot be loaded, thus hindering stacking of signatures. In addition, the stacking length of signatures is limited to a considerably small value, and signatures may be stacked irregularly.

In contrast, U.S. Pat. No. 4,172,531 has the arrangement that a plane for stacking signatures is defined by two parallel chain conveyors which are movable forwardly and the two conveyors, together with a front retainer, can be finely advanced. It is therefore possible to simultaneously advance the respective lower ends of signatures placed on the two conveyors.

However, in the above-described arrangement a succeeding signature is loaded downwardly along the rear end of a stack of signatures. Therefore, it is necessary that not only the central portion of the rear end of the stack of signatures but also two lateral edge portions thereof be uniformly advanced. If, when the stack of signatures is advanced, two lateral edge portions of the rear end of the stack are left behind the central portion thereof, the remaining portions will interfere with the leading edge portion of a succeeding signature and thus prevent smooth loading of the following signature.

As a means for preventing this problem, it may readily be conceived to provide four chain conveyors which are conventionally known in order to advance two lateral edge portions of each signature by two outer chain conveyors in the same manner as the central portion thereof.

However, signature stacking apparatuses are preferably designed to have general-purpose property which enables them to cope with variations in width of signatures which are to be stacked. From this point view, the above-described improvement is considered to be unsatisfactory.

In connection with this, U.S. Pat. No. 4,172,531 discloses an apparatus wherein a signature loading belt mechanism is moved parallel backwardly with respect to a front retainer by a distance corresponding to the thickness of a signature to be loaded and an amount of displacement of the mechanism is transmitted to a cam by which a pneumatic valve is selectively opened and closed to control the amount of air supplied to an air motor so that the front retainer is advanced by the operation of the air motor by a distance corresponding to the amount of backward displacement of the belt mechanism and this advancement of the front retainer results in the belt mechanism returning to its initial position.

However, since this apparatus uses a parallel movement mechanism having a relatively large mass and employs a compressed fluid as a working medium, it is unsatisfactory in follow-up capability required in a high-speed repetitive operation, that is, the apparatus lacks rapid and accurate response, which means that it is impossible to obtain a desired effectiveness. Further, loaded signatures are aligned in such a manner that lateral positions thereof are not in exact register with each other, and this irregularity cannot be corrected.

After signatures have been stacked, it is necessary to protect the front and rear ends of the stack of signatures so that they are not bent or folded.

Concerning the protection of the front end of a stack of signatures, the aforementioned Japanese Patent Laid-Open No. 135192/1984 discloses the following technique.

Namely, the front end of a stack of signatures is reliably retained by a front retainer having a panel. However, retaining by the panel cannot be executed from the beginning of the formation of a stack of signatures for various reasons, and the panel awaits arrival of the front end of the stack of signatures at a position halfway the path defined by a guide plate. Accordingly, stacking of signatures proceeds in a state wherein the front end of the stack of signatures is supported by a temporarily retaining means which is constituted by two upstanding rods during the period which begins at the time of starting stacking of signatures and which ends at the time when the front end of the stack reachs the intermediary position.

However, since the front end of the stack of signatures is temporarily retained by two upstanding rods alone, two lateral edge portions of the foremost signatures are turned up forward in response to the stacking pressure as shown in FIG. 26. This turning up phenomenon becomes more noticeable as the degree of limpness of paper increases and the thickness of paper decreases. When the stack of signatures advances to the panel in the above-described turned up state, a signature which defines the front end of the stack or the foremost signatures including it are undesirably folded, and the signatures thus folded are supplied to the bookbinding step, which results in considerable lowering in the quality of books.

Concerning the attachment of a panel to the rear end of a stack of signatures, the applicant of this application has already disclosed a means wherein, as shown in Japanese Patent Laid-Open No. 135192/1984, a stack of signatures is transported by being pushed with a fork-shaped rear retaining and transporting plate and an auxiliary plate is moved toward the rear end of the transported stack in a direction in which the former faces the latter in order to define a gap between the auxiliary plate and the transporting plate, and a panel is inserted into the gap thus formed.

However, since the rear end of the stack of the signatures is pushed by the rear retaining and transporting plate which is substantially constituted by two rods, the portion of the rear end which is between the two rods is caused to bulge rearward; in such case, the maximum thickness of the bulge exceeds the thickness of the transporting plate and this portion projects rearwardly beyond the plate.

Accordingly, when the panel is inserted along such bulged rear end in a direction parallel to the plane of the latter, the leading end of the panel comes into contact with the upper end of the bulged portion of the rear end of the stack of signatures and presses the latter downward. In consequence, the rear end of the stack is depressed downward and crushed to interfere with the downward movement of the panel, so that the panel is stopped in the course of insertion, thus obstructing tying and baling operations carried out thereafter. In addition, the crushed signatures cannot be used and therefore must be discarded wastefully.

SUMMARY OF THE INVENTION

A first object of the present invention is to provide a signature stacking apparatus having general-purporse property which enables it to cope with variations in the difference in terms of thickness between the upper and lower sides of a stack of signatures which are disposed vertically and stacked horizontally.

A second object of the present invention is to provide an efficient signature stacking apparatus which is so designed that signatures which are stacked impose no load on one another and any deformation of a stack of signatures which is caused due to a difference in terms of thickness between the folded side and cut side of each signature is avoided to thereby enable a relatively large number of signatures to be stacked and tied at a time.

A third object of the present invention is to provide a signature stacking apparatus which is so designed that, even if each of the signatures to be stacked consists of a relatively small number of pages or even if the paper is relatively thin and limp, there is no fear of signatures being stacked irregularly due to buckling, and it is possible to eliminate problems generally experienced when signatures are stacked, such as irregular alignment, folding of edges, and generation of folding marks or scuff marks, and to enable signatures to be stacked reliably, stably and smoothly.

A fourth object of the present invention is to provide a signature stacking apparatus which is capable of following a high-speed operation satisfactorily.

A fifth object of the present invention is to provide a signature pressing apparatus which is capable of reducing the thickness of each signature to increase the stacking density and yet involves no fear of the folded line of the pressed signature being cut when stitched by a stitching wire, thus enabling reliable and stable stitching effectiveness to be obtained.

A sixth object of the present invention is to provide an apparatus which is capable of reliably and quickly responding to a change in thickness of signatures to be loaded and a change in the loading speed and thus enables signatures to be stacked smoothly and regularly.

A seventh object of the present invention is to provide a simple and inexpensive signature stacking apparatus which can readily be obtained by remodeling an existing mechanism without the need to change the arrangement thereof to a substantial extent.

An eighth object of the present invention is to provide a signature stacking apparatus which has less possibility of having failures and can readily be maintained and adjusted.

A ninth object of the present invention is to accomplish the following objects:

first, to enable a succeeding signature to be loaded smoothly and easily by advancing two lateral edge portions of the rear end of a stack of signatures in a manner similar to that for the central portion thereof;

secondly, to make it possible to reliably and readily cope with a change in width of signatures to be loaded;

thirdly, to enable the side edges of stacked signatures to be in exact register with each other by quickly correcting any irregularity of the side edges of loaded signatures; and fourthly, to enable a large number of signatures to be stacked regularly and permit an excellent stack of signatures to be supplied to a subsequent bookbinding step by the accomplishment of the above-described objects.

A tenth object of the present invention is to provide an automatic apparatus which prevents the front end of a stack of signatures from being turned up forward, thereby allowing an excellent stack of signatures which is not folded or bent when a panel is attached to the front end thereof to be supplied to a bookbinding step.

An eleventh object of the present invention is to provide an apparatus which is capable of reliably and readily coping with variations in width of signatures to be stacked on a guide plate, thereby accomplishing the above-described tenth object.

A twelfth object of the present invention is to provide a method and apparatus capable of attaching a panel to the rear end of a stack of signatures in a completely normal state without any fear of said rear end being crushed, broken or stained.

To attain the first to fourth objects, according to the present invention, a slide-like guide plate 14 which has a predetermined angle of inclination throughout it is provided as a guide plate for stacking signatures as shown in FIG. 1, and signatures are loaded onto the uppermost portion of the guide plate 14 from the upper side of the latter as indicated by the arrow 15. The foremost end of the stack of signatures is supported through the first-half of the transport path by a first support member 16 which gradually lowers from the signature loading position to an intermediary position, and is supported through the second-half of the transport path by a second suppor member 17 which moves from the intermediary position to a stack unloading position. At the same time, the rearmost end of the stack of signatures is supported by a third support member 18 through the entire transport path from the uppermost position of the guide plate 14 to the end of the stack unloading position. For this purpose, the first, second and third support members are arranged so as to operate in relation to each other.

By virtue of the above-described arrangement of the present invention, the guide plate, which has a predetermined angle of inclination throughout it and a curvature of 0, effectively copes with variations in the difference in terms of thickness between the upper and lower sides of signatures to be stacked.

More specifically, since signatures are stacked on a slope, load which is applied to each signature is concentrated on the lower part thereof, that is, the folded side which is relatively thick, whereas the cut side of the signature which is relatively thin is saved from being heavily loaded. Accordingly, even when signatures involve a relatively large difference in terms of thickness between the upper and lower sides thereof, it is easy for the upper portions of the signatures to assume respective postures which are independent of each other. When said thickness difference is relatively small, the above-described favorable phenomenon takes place even more stably. Thus, the slanting guide plate having a curvature of 0 has the greatest general-purpose capability to cope with variations in the difference in terms of thickness between the upper and lower sides of signatures to be stacked.

For the same reason as the above, it is possible to avoid occurrence of deformation of a stack which would otherwise be caused due to the difference in terms of thickness between the folded side and cut side of each signature.

When there is an extremely large difference in terms of thickness between the upper and lower sides of signatures, there is a fear of the signatures being stacked irregularly due to buckling. However, since load is concentrated on the lower portion of each signature by virtue of the slanting guide plate having a curvature of 0, a relatively strong pressure acts on the thick lower portion of the signature to reduce the thickness, and the pressure gradually lowers toward the upper side of the signature. This unique load distribution enables prevention of irregular stacking due to buckling of signatures.

Since signatures are stacked on a slope, problems such as irregular stacking, folding of edges and generation of folding marks or scuff marks are reduced as compared with the prior art in which signatures are loaded vertically and stacked horizontally.

Since two difference kinds of support member are respectively employed for the first half and second half of a stacking operation, the throughput per unit of time is increased, so that the present invention is capable of satisfactorily coping with a high-speed operation.

To attain the fifth object, the present invention provides the following arrangement. In a pair of rotary systems for pressing a signature which have a width longer than the fold line of the signature and respectively peripheral surfaces which are able to continue to be in endless contact with each other, at least one pressure relief groove is circumferentially provided along the peripheral surface of at least one of the rotary systems, the groove being disposed at a position corresponding to a saddle stitching position on the signature which is to be pressed by the rotary systems.

When a signature is pressed between the pair of rotary systems, the fold portion of the signature which is passed through the area of contact between the the rotary systems is pressed so as to have an acute folding angle, but the fold portion of the signature which is passed through the contact area including the pressure relief groove is pressed so as to have a relatively obtuse folding angle and therefore folded so as to have a curved surface although the curvature thereof is very small. Accordingly, when this portion is stitched with a stitching wire, there is no fear of the stitched portion being cut, and it is therefore possible to effect reliable stitching.

Since a stitched portion where a stitching wire is driven is limited to a considerably small area with respect to the entire length of the fold line, the stitched portion, which is not folded acutely, will not hinder reduction in the entire thickness of the signature. Accordingly, it is possible to obtain a high signature stacking density which is on the same level as that in the prior art.

To attain the sixth to eighth objects, according to the present invention, an oscillating member is provided which supports a conveyor for loading a succeeding signature along the rear end of a stack of signatures in such a manner that the conveyor is moved backward with respect to a front retainer against the force from a spring by a distance corresponding to the thickness of a signature to be loaded. Further, a transducer is provided for converting the amount of mechanical backward displacement into an electrical amount, which is input to a drive means to move the front retainer by a distance corresponding to an amount of mechanical forward displacement which corresponds to the output of the transducer.

Every time the conveyor is pivotally moved backward by the oscillating member, the amount of mechanical backward displacement of the conveyor is converted into an electrical amount by which the drive means is activated to advance the front member by a distance corresponding to the electrical amount. In consequence, the whole of the stack of signatures is advanced, and the conveyor is also returned to its initial position by the force from the spring.

Since the above-described operation takes place repeatedly every time a signature is loaded, loaded signatures are stacked smoothly and regularly.

To attain the ninth object, according to the present invention, a feed member is provided at a position where it is able to come into contact with one side edge portion of a signature loaded onto a plane, and a drive means is provided for enabling the feed member to move in the direction of advancement of the stack of signatures while maintaining the contact with said side edge portion.

Thus, since each side edge portion of a loaded signature is advanced by the action of the feed member without being left behind the advanced central lower end edge portion of the signature, the rearmost signature of the stack of signatures is advanced uniformly throughout it, thus allowing a succeeding signature to be smoothly loaded onto the plane without any hindrance.

At the same time, any sideward offset of each of the loaded signatures is quickly corrected by the feed member so that each signature is disposed at an appropriate position on the plane.

To attain the tenth and eleventh objects, according to the present invention, a support member is moved while being in contact with one lateral edge portion of the front end of a stack of signatures during the time when the central portion of the front end of the stack is being supported by a temporarily retaining member. On the other hand, a force counter to the direction of advancement of the stack of signatures is applied to the support member. Further, the support member is retracted to the outside of the signature stacking space at a position where supporting effected by the support member ends, and is advanced at a position where supporting by the support member starts. Alternatively, in addition to the above-described arrangement, the contact position of the support member is allowed to move in a direction perpendicular to the direction of advancement of the stack of signatures.

It is possible to advance the front end of a stack of signatures to a panel stand-by position in a state wherein lateral edge portions of the front end of the stack are prevented from being turned up, by controlling the level of force, which is applied to the support member brought into contact with the lateral edge portion of the front end of the stack, to a relative pressure with which at least the front end lateral edge portion is prevented from projecting forward beyond the central portion of said front end.

If the arrangement is such that, when the front end of the stack of signatures reaches the panel, the support member is positively retracted to the outside of the signature stacking space, or the support member is automatically moved out of the signature stacking space at the panel stand-by position by the action of an appropriate mechanism, when the support member is released from the pressure from the stack of signatures, the former is automatically returned to the supporting start position or to the outer side thereof by the action of the abovedescribed relative pressure.

In the case where the support member is returned to the outer side of the supporting start position, when the support member is advanced to its operative position, the front end of a subsequent stack of signatures is supported thereby.

If the position of contact of the support member with the front end of a stack of signatures is moved for adjustment, it is possible to cope with variations in the width of various kinds of signature.

To attain the twelfth object, according to the present invention, an intermediary box which has a gap for receiving a panel is attached to the rear end of a stack of signatures in a direction in which the former faces the latter, the panel is inserted into the box, and then the box is left alone behind the rear end of the stack in a direction parallel to the plane of said rear end.

More specifically, an intermediary box having a gap for receiving a panel is attached to the rear end of a stack of signatures in a direction in which the former faces the latter, that is, in a direction in which the rearwardly bulging potion of the rear end of the stack is pushed back so as to be eliminated, and a panel is inserted into the box so as to be indirectly supplied. Thereafter, the box is left alone behind the rear end of the stack of signatures in a direction parallel to the plane of said rear end. It is therefore possible to attach the panel to the rear end of the stack without any damage to said rear end.

BRIEF DESCRIPTION OF THE DRAWINGS

FIGS. 12 to 14 are enlarged perspective views respectively illustrating various embodiments of signature pressing mechanisms 43 and 44 provided in the signature introducing section, in which FIGS. 12, 13 and 14 show first, second and third embodiments, respectively;

FIG. 18 is a vertical sectional front view taken along the line 18—18 of FIG. 17;

FIG. 19 is a fragmentary perspective view of the arrangement shown in FIG. 17 as viewed from the obliquely forward side thereof;

FIG. 20 is a perspective view illustrating a modification of the arrangement shown in FIG. 19;

FIG. 21 is a perspective view illustrating a third modification of the arrangement shown in FIG. 19;

FIG. 22 is a perspective view illustrating a fourth modification of the arrangement shown in FIG. 19;

DESCRIPTION OF THE PREFERRED EMBODIMENTS

Figure 1:
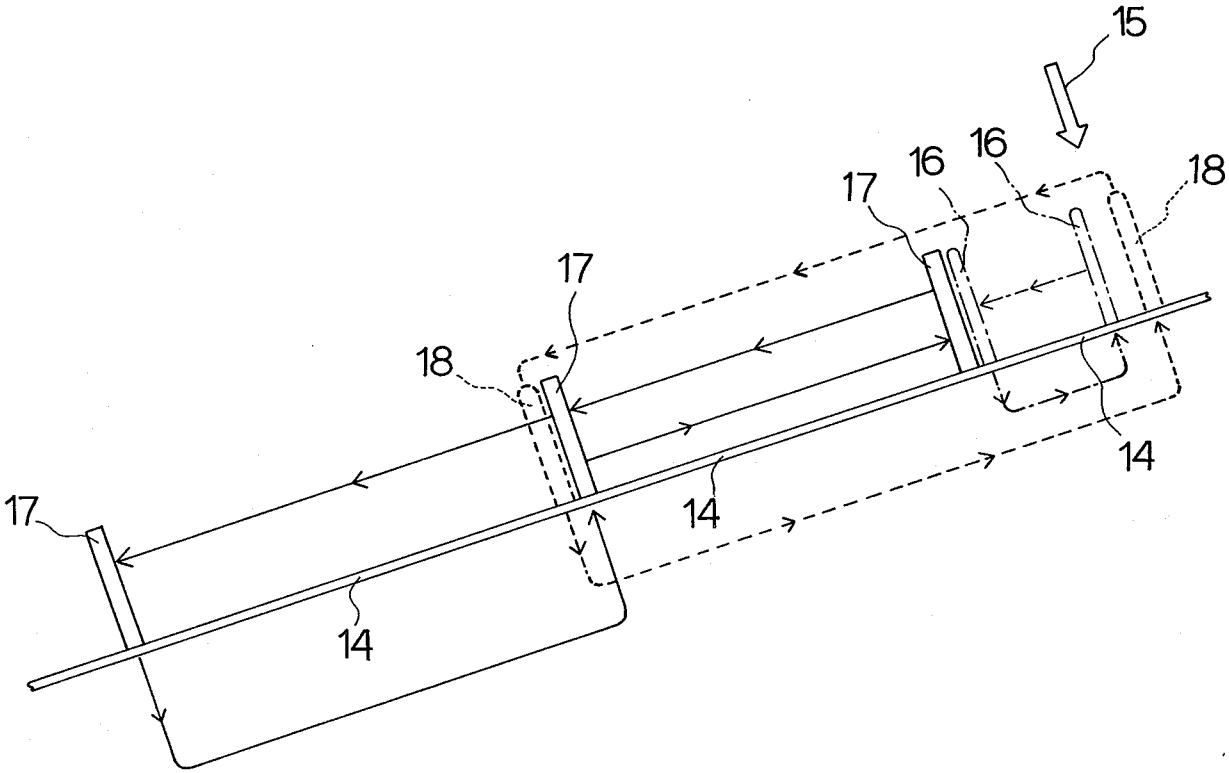
FIG. 1 is a view schematically illustrating the signature stacking apparatus according to the present invention.

A guide plate 14 for stacking signatures which is used in the present invention is defined by a slide-like slope having a predetermined angle of inclination throughout it. A transport means is provided at the same level as that of the surface of the slope, the transport means including a combination of a first support member 16 and a second support member 17 which are adapted to support the foremost surface of a stack of signatures and move along a slit longitudinally provided in the guide plate 14, the support members 16 and 17 being further adapted to emerge and withdraw from the surface of the guide plate 14. Signatures are transported onto the uppermost portion of the guide plate 14 from the upper side of the latter, for example, in a direction perpendicular to the surface of the guide plate 14.

The way in which signatures are loaded onto the stacking section will first be explained below.

A stream 20 of signatures, which partially overlap each other in such a manner that the folded side of one signature is laid on the cut side of another signature which is adjacent and precedent thereto, is successively transported by five lower conveyors 21, 22, 23, 24 and 25, which are disposed in series, to reach the guide plate 14.

While the stream 20 of signatures is on the first lower conveyor 21, the bulge at the folded side of each signature is eliminated and respective lateral edges of the signatures are aligned so as to be in exact register with each other. Any discontinuance of the stream 20 is corrected by the action of the second lower conveyor 22. The number of signatures which constitute a stream 20 is counted at the third lower conveyor 33. The stream 20 of signatures is divided into discrete signatures at the fourth lower conveyor 24, and the signatures in the discrete state are then introduced onto the guide plate 14 in a direction approximately perpendicular to the plane of the guide plate 14.

Figure 3:
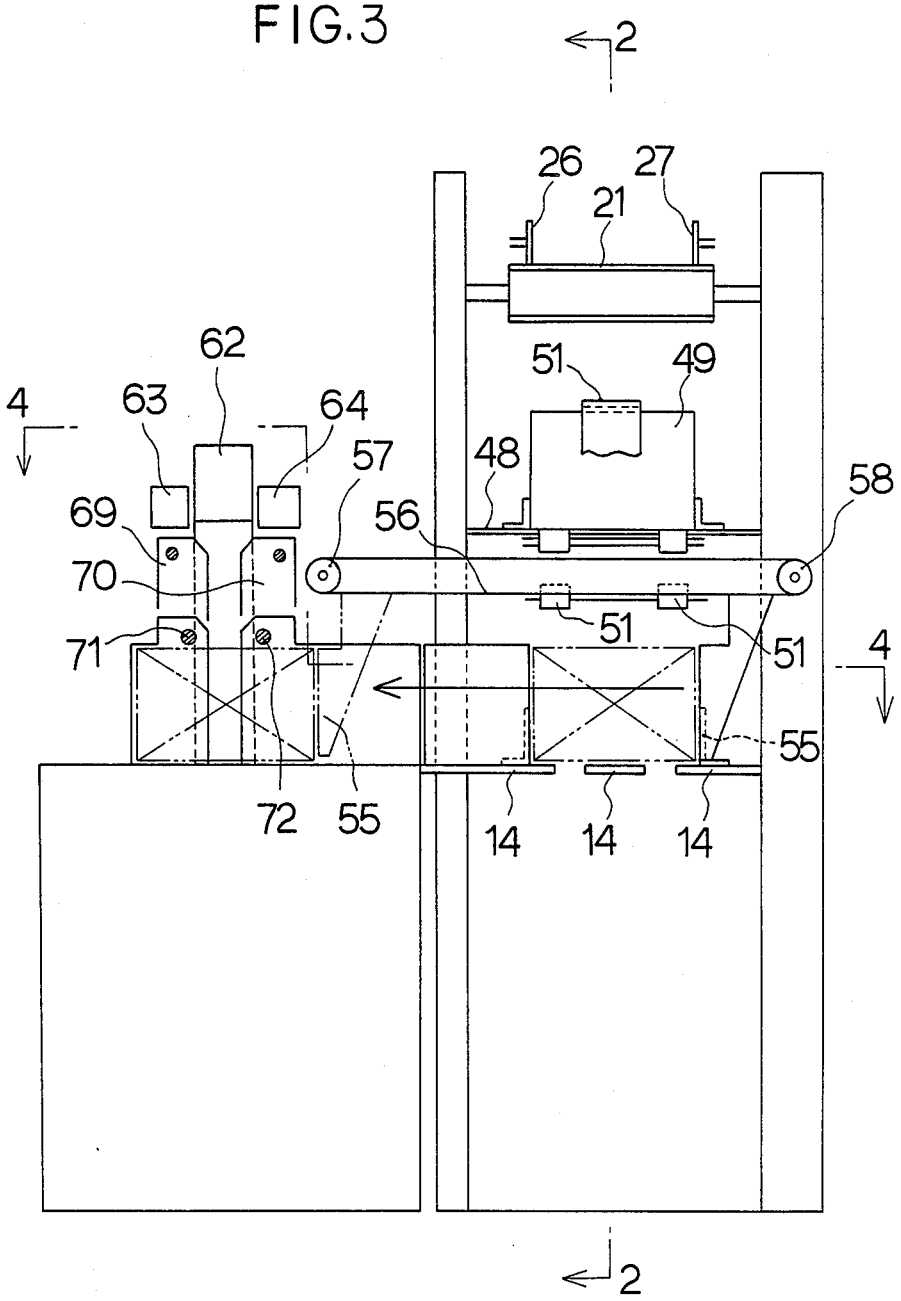
FIG. 3 is a front view of the embodiment shown in FIG. 2 as viewed from the left-hand side thereof.

A pair of upper and lower pressure rollers 43 and 44 are disposed in opposing relation to each other across the first lower conveyor 21 so that the stream 20 of signatures travels through the area between the rollers 43 and 44. The force required for the rollers 43 and 44 to press the signatures may be obtained from, for example, a spring (not shown) in the form of resilient force. As the signatures travel through the area between the rollers 43 and 44, the bulge at the folded side of each signature is eliminated by the pressure applied from the rollers 43 and 44, thus minimizing the difference in terms of thickness between the folded side and cut side of the signature. The smaller the difference between the respective thicknesses of the leading and trailing ends of each signature, the smaller the difference in terms of thickness between the upper and lower sides of stacked signatures and the smaller the degree of slope of the stack of signatures, which means that the number of signatures which can be stacked at a time is increased. Subsequently, a pair of oscillating side plates 26 and 27 are provided on the upper side and at two lateral edges, respectively, of the lower conveyor 21 as shown in FIG. 3. The pair of side plates (joggers) 26 and 27 are adapted to jog both lateral edges of the stream 20 of signatures in order to correct any misalignment of the lateral edges of the signatures.

Figures 2, 5:
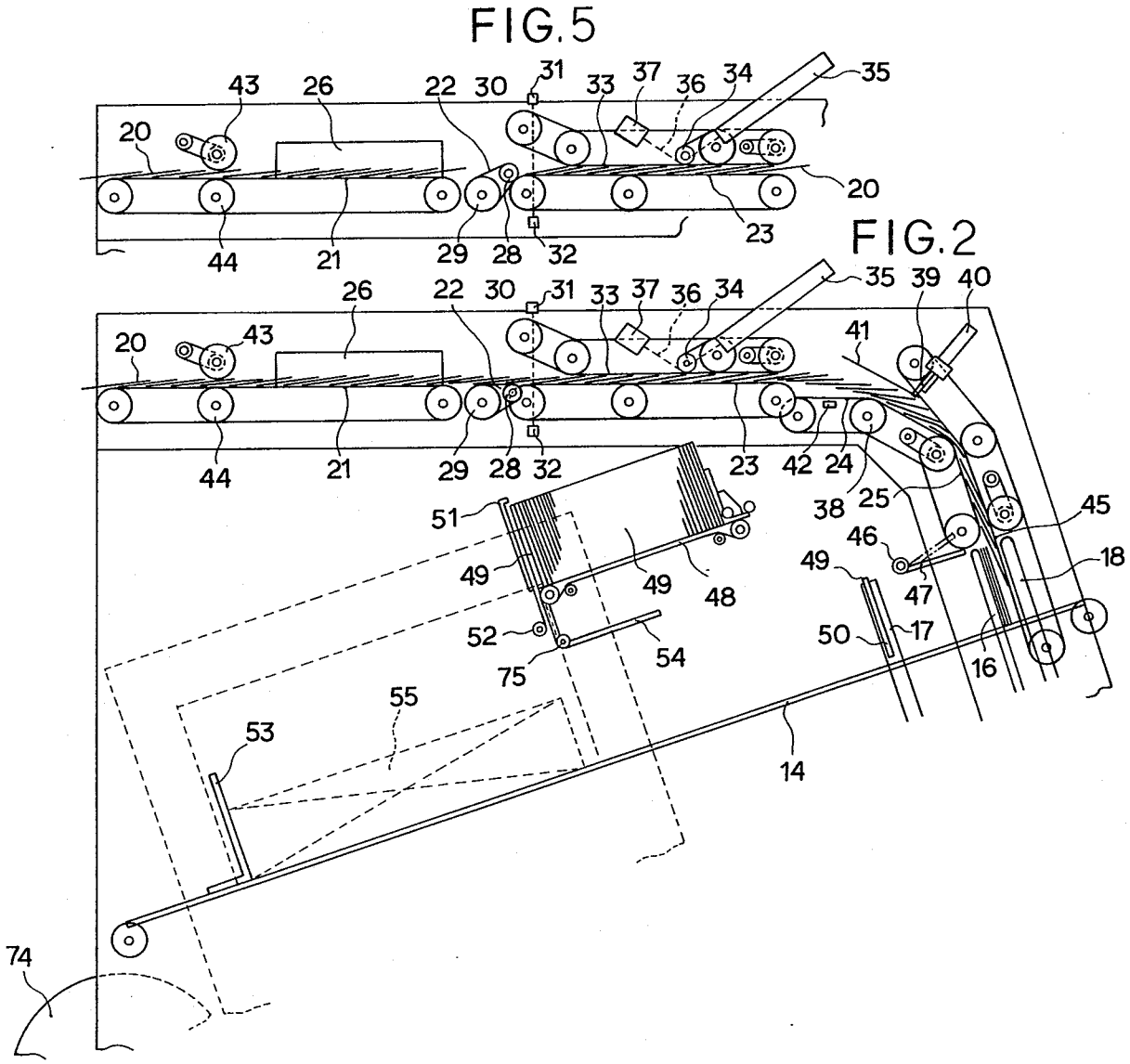
FIG. 2 is a vertical sectional view taken along the line 2—2 of FIG. 3, which illustrates one practical embodiment of the apparatus shown in FIG. 1.
FIG. 5 is a fragmentary vertical sectional view illustrating a signature stream interruption correcting mechanism provided in a signature introducing section which is in an operative state in contrast to the corresponding part of the arrangement shown in FIG. 2.

As shown in FIGS. 2 and 5, the second lower conveyor 22 has an extremely short length, and a downstream pulley 28 has a smaller diameter than that of an upstream pulley 29. The relatively small pulley 28 is adapted to project obliquely upward toward the downstream side along an arcuate path whose center of a curvature is located on the axis of a shaft for the upstream pulley 29 (see FIG. 5). A light projector 31 and a light receiver 32 are provided immediately downstream of the small pulley 28 in such a manner that a beam 30 of light crosses vertically the stream 20 of signatures. The arrangement is such that, when the stream 20 of signatures becomes discontinuous, the light beam 30 is received by the light receiver 32 and the latter generates a signal. In response to this signal, not only the operation of the downstream conveyors 23, 24 and 25 but also the operation of the stacking section are temporarily suspended and, at the same time, the small pulley 28 is caused to project so that the upper stretch or reach of the conveyor 22 defines an ascending slope. Accordingly, after the interruption of the stream 20 of signatures, the leading end of the following stream 20 of signatures advanced on the first conveyor 21 rides on the small pulley 28 to cut off the light beam 30, resulting in generation of a cut-off signal which causes the small pulley 28 to be lowered. In consequence, the leading end of the following stream 20 of signatures is laid on the trailing end of the preceding stream 20 of signatures and, at the same time, the operation of the downstream conveyors 23, 24 and 25 and that of the stacking section are resumed. Interruption of the stream 20 of signatures 20 may be caused by extraction of one or more signatures for the inspection purposes or due to spoilage. Any interruption of the stream 20 of signatures impairs normal operations of various mechanisms at the downstream side as viewed from a position where such interruption occurs, or causes jamming or irregularity in alignment of signatues. It is therefore necessary to correct the interrupted stream 20 of signatures before they are introduced into the mechanisms at the downstream side.

An upper conveyor 33 is provided above the third lower conveyor 23 to press, particularly by the action of a presser pulley 34, the stream 20 of signatures so that they are prevented from rising. The stream 20 of signatures thus pressed satisfactorily is irradiated with a laser beam 36 from a laser oscillator 35 disposed above and downstream of the irradiated position so that the laser beam 36 is obliquely incident on the upper side of the stream 20, and the light reflected therefrom is received by a light receiver 37. Since the laser beam 36 is interrupted every time the leading end of each signature passes this detecting position, the number of passing signatures can be detected by counting the number of times of interruption of the laser beam 36.

The fourth lower conveyor 24 runs horizontally, whereas the fifth lower conveyor 25 is slanted to run obliquely downward in order to regulate the postures of signatures so that they are introduced to the guide plate 14 in a direction perpendicular to the plane of the guide plate 14.

The bend of the transport path between the horizontal section and the obliquely downward section is formed at the position of an intermediary pulley 38 which intermediates between the fourth and fifth conveyors. At this bend, the leading end edge of each signature is separated from the upper surface of the preceding signature to produce a gap therebetween. According to the present invention, the stream 20 of signatures is divided by making good use of the phenomenon that the leading end of each signature is separated from the preceding signature at the moment said leading end passes the bend of transport path. The dividing mechanism is, of course, activated in close cooperation with the above-described counting mechanism.

The dividing mechanism consists of a dividing plate 39 provided immediately downstream of the intermediary pulley 38 at a position which faces the pulley 38 obliquely downward, an air cylinder 40 for activating the dividing plate 39, an accumulating plate 41 provided above the intermediary pulley 38, and a lifting member 42 provided at a position which is immediately upstream of the intermediary pulley 38 and which is immediately below the conveyor 24. When a signal which indicates the completion of counting of a predetermined number of signatures is output from the counting mechanism, the air cylinder 40 is activated to lower the dividing plate 39 so as to intercept the succeeding stream 20 of signatures by the accumulating plate 41 and, at the same time, the lifting member 42 is projected above the conveyor 24 to raise the succeeding stream 20 of signatures to thereby remove the load from the rearmost signatures of the preceding stream 20. In consequence, said rearmost signatures are released and separated from the foremost signatures of the succeeding stream 20, thus achieving division of the stream 20 of signatures. Thereafter, each mechanism is returned to its initial position, and the succeeding stream 20 of signatures is transported on the conveyor 25.

The final lower conveyor 25 cooperates with an upper conveyor 45 disposed above it to reliably lead the signatures 20 to the guide plate 14 in a dierection perpendicular to the plane of the guide plate 14. The upper conveyor 45 is provided so as to extend below the plane of the guide plate 14 in order to enable the folded portion of each signature 20 to be reliably fed to the surface of the guide plate 14. The upper conveyor 45 further serves to prevent the signatures 20 from rising upward during transportation.

Stacking of signatures will next be explained.

The guide plate 14 for stacking signatures is defined by a slope having a predetermined angle of inclination as has already been described. Stacking of signatures is accomplished by the cooperation of the guide plate 14 and the first and second support members 16, 17 which share with each other in retaining the foremost end of a stack of signatures in such a manner that the first support member 16 retains said foremost end during a first half of each stacking operation and the second support member 17 retains said foremost end during a second half of the stacking operation, together with a third support member 18 which retains the rearmost end of the stack of signatures from beginning to end of each stacking operation.

As shown in FIG. 2, the first support member 16 plunges into the guide plate 14 from the outer side thereof along the prolongation line of the lower conveyor 25 to await oncoming signatures before the foremost portion of the divided stream of signatures is introduced to the upper part of the guide plate 14. As the signatures are started to be loaded onto the guide plate 14, the first support member 16 is gradually lowered (see FIG. 9) in accordance with the loading speed. The gradual lowering of the first support member 16 continues until it reaches the stand-by position of the second support member 17 (see FIG. 10) where the first support member 16 is withdrawn to the outside of the guide plate 14 (see FIG. 7).

Figure 6:
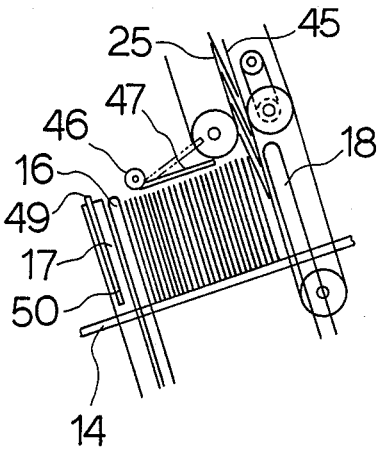
FIGS. 6 to 10 are fragmentary vertical sectional views successively illustrating the stacking operation according to the present invention.
Figure 10:
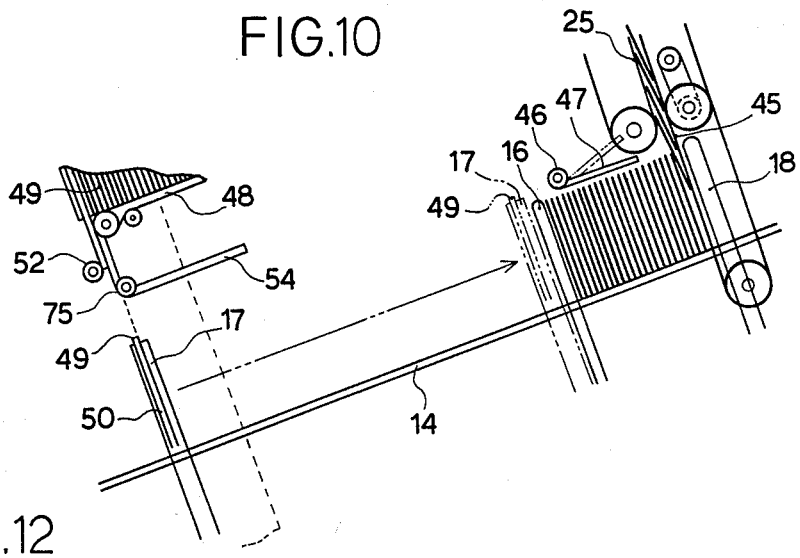

When the first support member 16 reaches its lower limit position, the second support member 17 is allowed to stand by at a position adjacent to the first support member 16 in timed relation to the downward movement of the latter, as shown in FIGS. 10 and 6.

Figure 7:
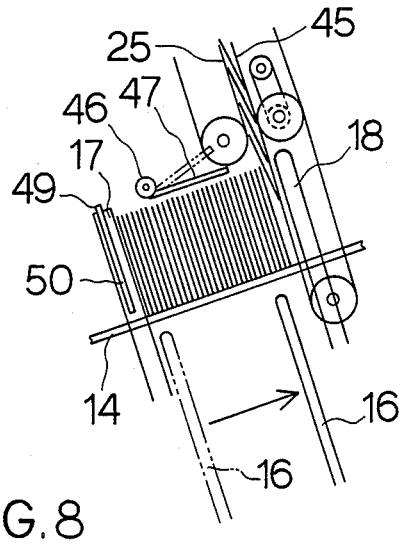

Accordingly, when the first support member 16 is withdrawn, supporting of the foremost end of the stack of signatures is automatically taken over from the first support member 16 to the second support member 17 (see FIG. 7).

The withdrawn first support member 16 is moved upward to the plunging position therefor to stand by thereat as shown in FIG. 7. When the loading of signatures is temporarily stopped by the action of the dividing plate 39, the first support member 16 plunges into the upper part of the guide plate 14 to await the following stream 20 of signatures.

Figure 8:
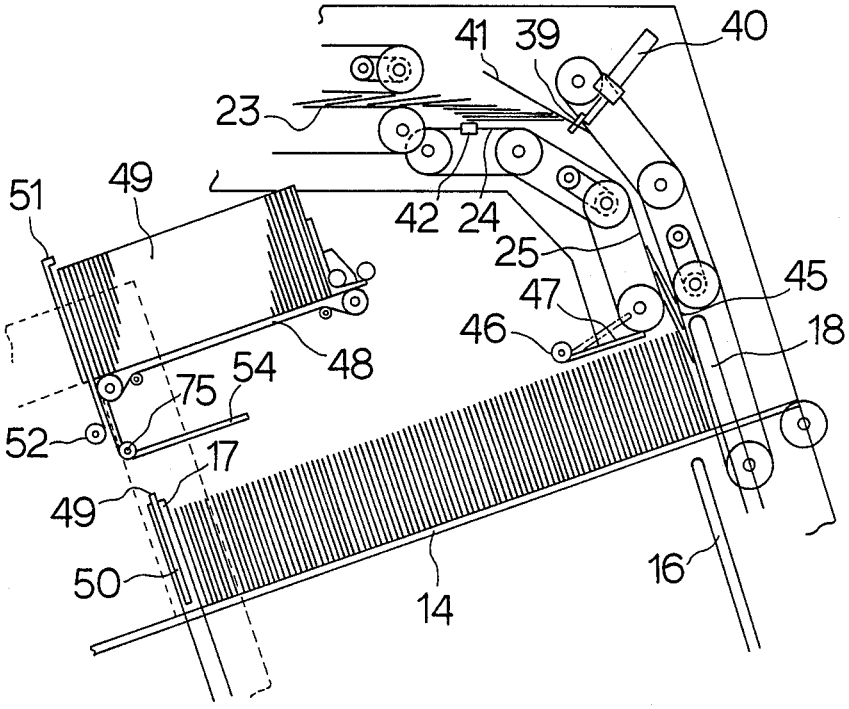
Figure 9:
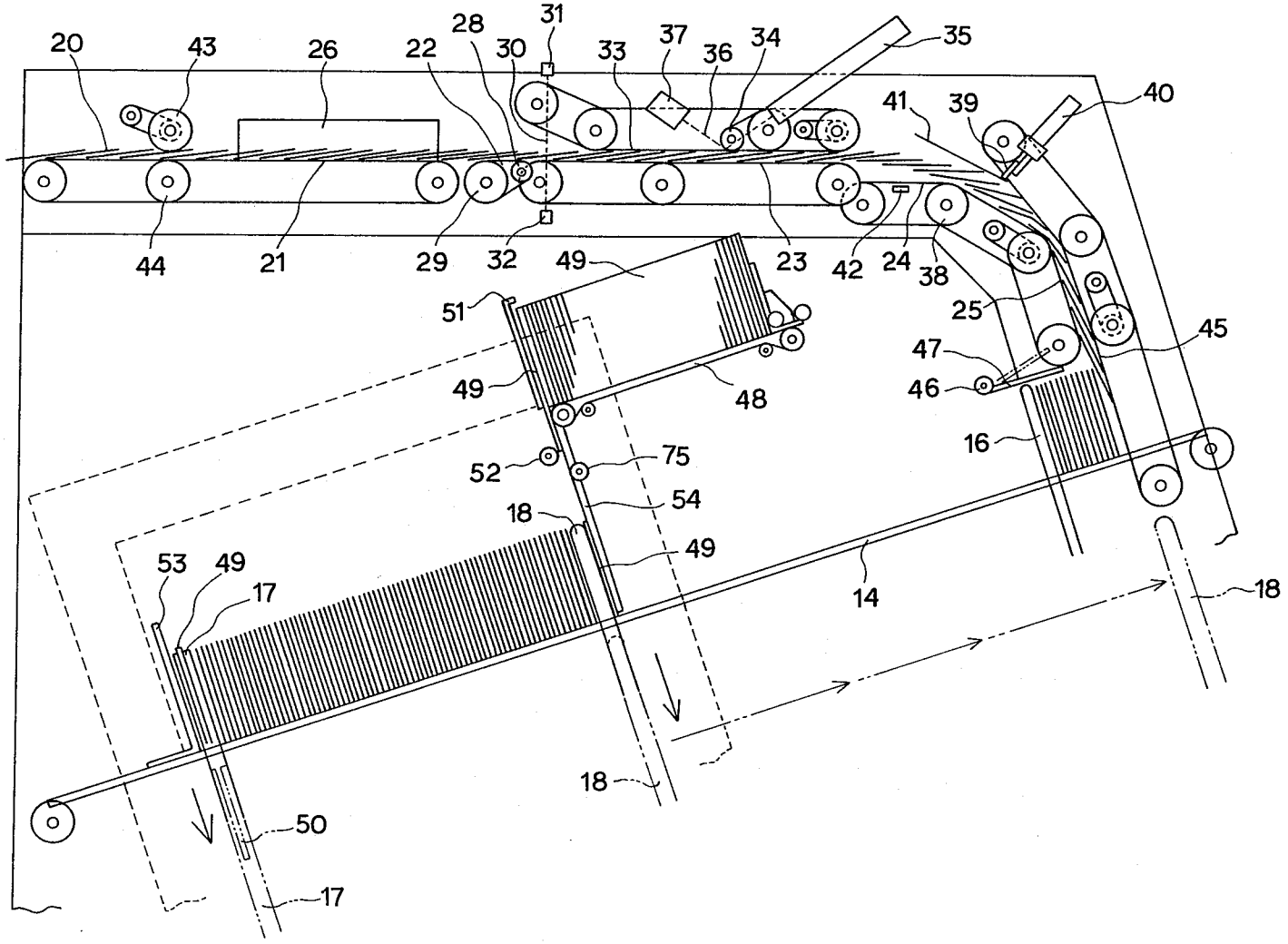

On the other hand, the second support member 17 which has taken over the supporting of the foremost end of the stack of signatures from the first support member 16 advances to a signature stack unloading position on the guide plate 14 while retaining the foremost end of the stack of signatures (see FIGS. 8 and 9).

The third support member 18 plunges into the guide plate 14 along the transport line of the upper conveyor 45 to stand by, and when the loading of signatures is temporarily stopped by the action of the dividing plate 39, that is, when signatures descending through the transport path (see FIG. 8) have already been received on the guide plate 14, the third support member 18 starts to lower and retains the rearmost end of the stack of signatures and then advances to the loading position on the guide plate 14 in cooperation with the second support member 17 to hold the stack (see FIG. 9).

It should be noted that panels are supplied in relation to the operation of the second and third support members 17 and 18, but description thereof is omitted here and will be made later in detail. After transporting the stack of signatures to the unloading position on the guide plate 14, the pair of front and rear support members 17 and 18 simultaneously withdraw to the lower side of the guide plate 14 and then return to their respective stand-by positions described above (see FIG. 1).

There is substantially no fear of signatures being stacked irregularly when they are loaded onto the guide plate 14. However, for extra insurance, a means for correcting any irregularity in alignment of signatures is provided above a growing stack which has not yet imposed a heavy load. More specifically, an oscillating plate 47 is provided at a position spaced apart from the guide plate 14 by a distance equal to the length of each signature, the plate 47 being adapted to pivot about the axis of a shaft 46 so as to jog the respective rear end edges of the signatures to thereby correct any irregularity in alignment of the growing stack of signatures.

Finally, unloading of a stack of signatures will be explained below.

In unloading, it is necessary to supply a pair of panels to the forward and rearward ends, respectively, of a stack of signatures, unload the stack from the guide plate 14 to one side thereof, compress the stack of signatures, and tie the compressed stack with a band.

It is conventional practice to apply two pieces of cardboard to the forward and rearward ends, respectively, of a stack of signatures. In the present invention, however, since a relatively large number of signatures can be stacked, any paper may be broken when a stack of a large number of signatures is tied with a band; therefore, two synthetic resin sheets or two pieces of veneer plywood are applied to the forward and rearward ends, respectivley, of the stack of signatures.

Referring to FIG. 1, a panel stack support plate 48 for stacking a multiplicity of panels thereon is provided above the signature stack unloading position in such a manner that a panel 49 which is disposed at the leftward end of the plate 48 is located immediately above the rearmost end of the signature stack unloading position, the panels 49 being successively supplied from the one which is at the leftward end. Although panels 49 are supplied to both ends, respectively, of a stack of signatures, the panel supplying process carried out at the forward end of a stack of signature differs from that at the rearward end thereof.

The way in which a panel 49 is supplied to the forward end of a stack of signatures will first be explained.

The second support member 17 is provided in advance with a notch 50 the upper side of which is open (see the two-dot chain line in FIG. 9). When the support member 17 passes the panel supply position to return to its initial position, it is temporarily stopped thereat and then plunged into the guide plate 14 (see FIG. 10) and, at this time, a panel 49 is supplied into the notch 50.

The supply of a panel 49 is effected as follows. A claw 51 is first activated to catch the upper end surface of a panel 49, thus causing the panel 49 to be pressed downward and then held by a rotating rubber roller 52, and in this way, the panel 49 is inserted into the notch 50 by virtue of the rotation of the roller 52.

The second support member 17 having the panel 49 inserted therein then returns to its stand-by position adjacent to the first support member 16 as shown in FIG. 6 to take over supporting of the foremost end of the stack of signatures from the first support member 16. Thereafter, as shown in FIG. 9, the second support member 17 advances to the forward end of the signature stack unloading position and withdraws to the lower side of the guide plate 14. At this time, the panel 49 alone is blocked by the guide plate 14 and thereby removed from the notch 50 and left on the guide plate 14, the outer side of the panel 49 being supported by a paper guide 53.

To supply a panel 49 to the rearward end of a stack of signatures, when the third support member 18 reaches the above-described panel supply position, an auxiliary plate 54 is lowered along the rear side of the support member 18 in response to the movement of the latter (see FIG. 9). The auxiliary plate 54 is able to pivot about a support shaft 75 so that the plate 54 is normally positioned so as to extend horizontally as shown in FIG. 10 to thereby open the path of the stack of signatures and, only when a panel 49 is supplied, the auxiliary plate 54 extends vertically.

The panel 49 is inserted into the area between the third support member 18 and the auxiliary plate 54 by the action of the rubber roller 52. Upon completion of the insertion of the panel 49, the third support member 18 is withdrawn below the guide plate 14.

Figures 4, 11:
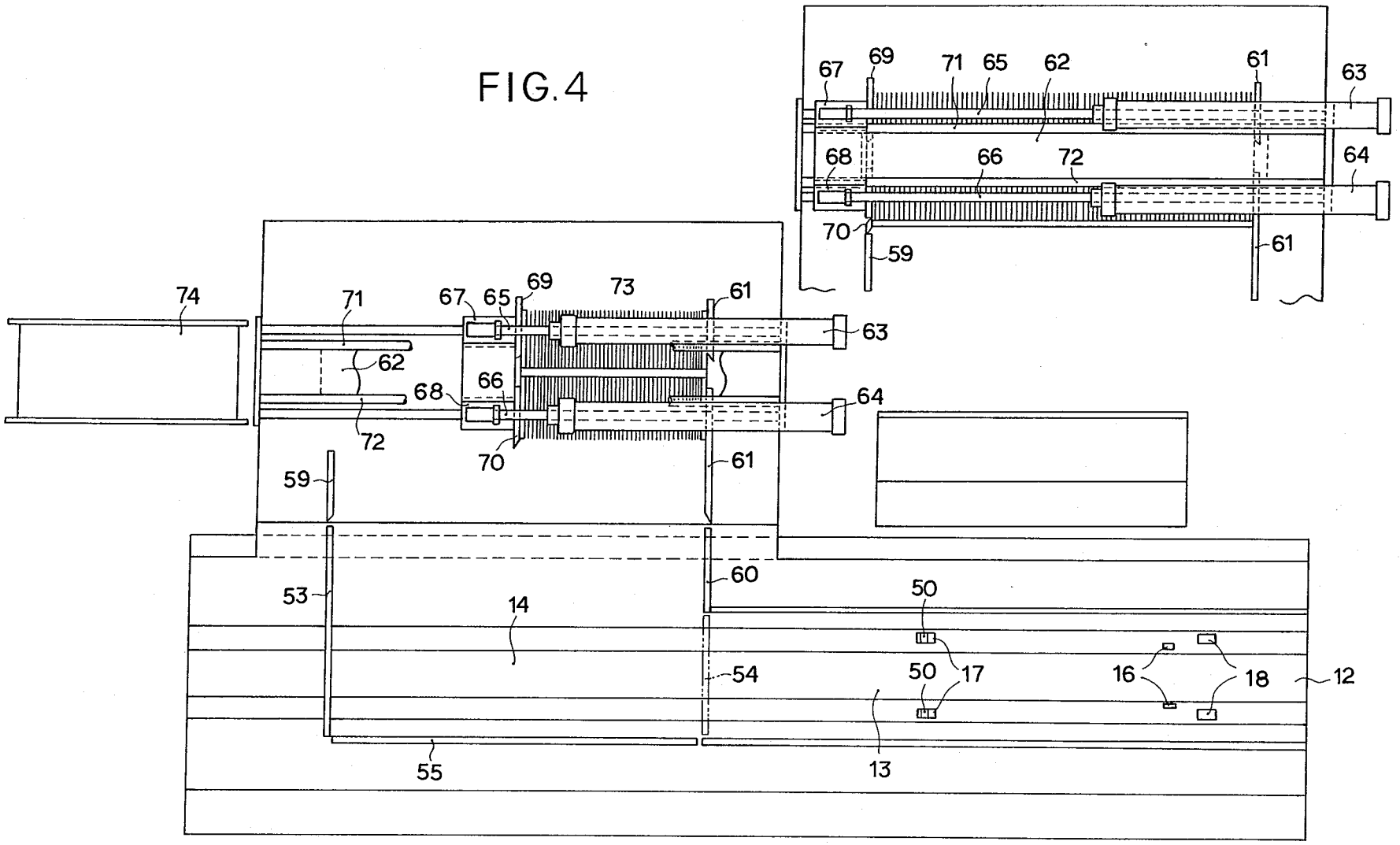
FIG. 4 is a horizontal sectional view taken along the line 4—4 of FIG. 3.
FIG. 11 is a fragmentary plan view illustrating a pressing and banding mechanism provided in the tying section which is in an operative state in contrast to the corresponding part of the arrangement shown in FIG. 4.

The stack of signatures having the panels 49 respectively applied to both ends thereof is unloaded to one side of the guide plate 14 by the action of a pusher plate 55 as shown in FIGS. 3 and 4.

The pusher plate 55 is rigidly secured to an endless chain 56 which is stretched between a pair of sprockets 57 and 58. The stack of signatures is transported by the operation of this set of transport means along paper guides 53, 59, 60 and 61 to reach a position immediately below a banding arch 62 having the same slope and the same height as the guide plate 14.

At the unloading position, the stack of signatures is pressed against the paper guides 61 by press plates 69 and 70 which are connected through brackets 67 and 68 to rods 65 and 66 of two cylinders 63 and 64, respectively (see FIGS. 4 and 11). The stack of signatures is held by a pair of bars 71 and 72 in order to prevent the signatures from being sprung up when they are pressed.

Upon completion of the pressing, the stack of signatures is tied with a band 73 which is led out of the arch 62, thus completing tying. The band 73 is supplied from a reel 74.

As has been detailed above, according to the present invention signatures are stacked on the guide plate 14 having a curvature of 0 and a predetermined angle of inclination in such a manner that the folded side of each signature face downward, and this produces a unique load distribution in which the maximum load concentrates on the lower part of each signature to strongly press it in the direction of thickness thereof to thereby thin this portion and in which the magnitude of the pressing force gradually lowers toward the upper part of each signature. As a result, the apparatus according to the present invention is provided with flexibility which enables the apparatus to widely cope with variations in the difference in terms of the thickness of signatures between the upper and lower parts thereof. Further, there is no fear of signatures being stacked irregularly or deformation of a stack of signatures due to buckling, and there is also no risk of signatures being folded at their edges or marked by folding or scuffing. In addition, the present invention enables a considerably large number of signatures to be stacked at a time by the action of the first and second support members 16 and 17, and this permits the apparatus to operate at high speed.

Figure 12:
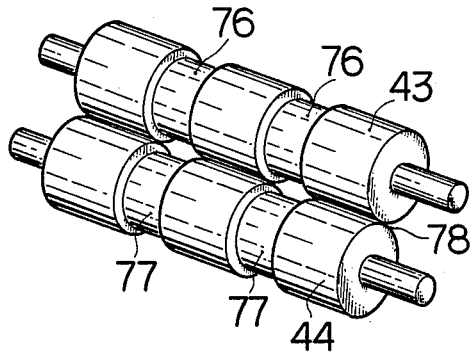
Figure 14:
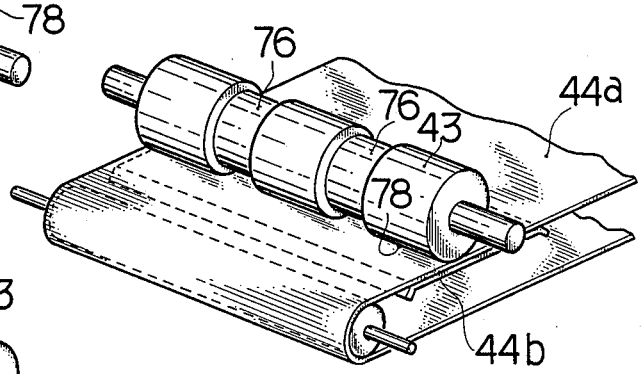
Figure 13:
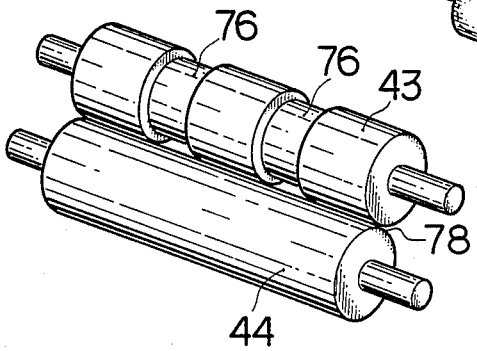

FIGS. 12 to 14 respectively show first to third embodiments of the signature pressing apparatus according to the present invention. A signature (not shown) is passed through a press area 78 defined between a pair of rotary systems 43 and 44 which are in endless contact with each other, the rotary systems 43 and 44 having a width longer than the fold line of the signature, whereby an acute folding angle is formed at the folded side of the signature and the thickness of the signature is reduced. The pair of rotary systems 43 and 44 may be defined by a pair of rollers as shown in FIGS. 12 and 13. Alternatively, the pair of rotary systems 43 and 44 may be defined by a combination of one rotary system which is constituted by, for example, the roller 43, and the other rotary system which is constituted by, for example, an endless belt **44*a* and an auxiliary plate 44*b* for pressing which is provided on the lower surface of the endless belt 44*a***.

Pressure relief grooves 76 and 77 are circumferentially formed in the peripheral surface of at least one of the pair of rotary systems 43 and 44, for example, the roller 43. However, the grooves 76 and 77 may be formed on both the rotary systems 43 and 44 as shown in FIG. 12.

The grooves 76 which are formed in the peripheral surface of the roller 43 need to correspond to saddle stitching positions, respectively, of a signature which is to be pressed by the roller 43. The width of the grooves 76 is preferably set so as to be equal to or longer than the width of saddle stitching, that is, the length of stitching by a stitching wire. However, the present invention is still effective even when the groove width is slightly shorter than the saddle stitching width.

It is generally preferable that the number of grooves 76 (77) per roller be equal to the number of stitching wires which are driven along the fold line of a set of signatures. However, the present invention is still effective even when said number of grooves 76 (77) is greater or smaller than said number of stitching wires. In the illustrated embodiments, two grooves 76 or 77 are provided per roller.

The depth and configuration of the grooves 76 and 77 are not particularly limited, provided that the grooves which are actually formed provide effectiveness in preventing a folded portion of a signature which is to be stitched from becoming acute.

In the illustrated embodiments, the width of the pressure relief grooves 76 and 77 is made greater than an actual one with respect to the entire width of the rollers 43 and 44 due to restriction by the size of paper and for the purpose of facilitating illustration. In practice, the total length of stitching wires, that is, the grooves 76 or 77, with respect to the overall length of the folding line of a signature is considerably small, and therefore the provision of the grooves 76 or 77 causes substantially no reduction in the pressing effectiveness. Accordingly, it is possible to expect the same pressing effectiveness as that obtained conventionally by employing the rollers 43 and 44 according to the present invention.

Since the provision of the grooves 76 prevents stitch portions along the folding line of a signature from becoming acute, there is no fear of wire-stitched portions being cut. Accordingly, it is advantageously possible to stitch signatures reliably and stably.

Figure 15:
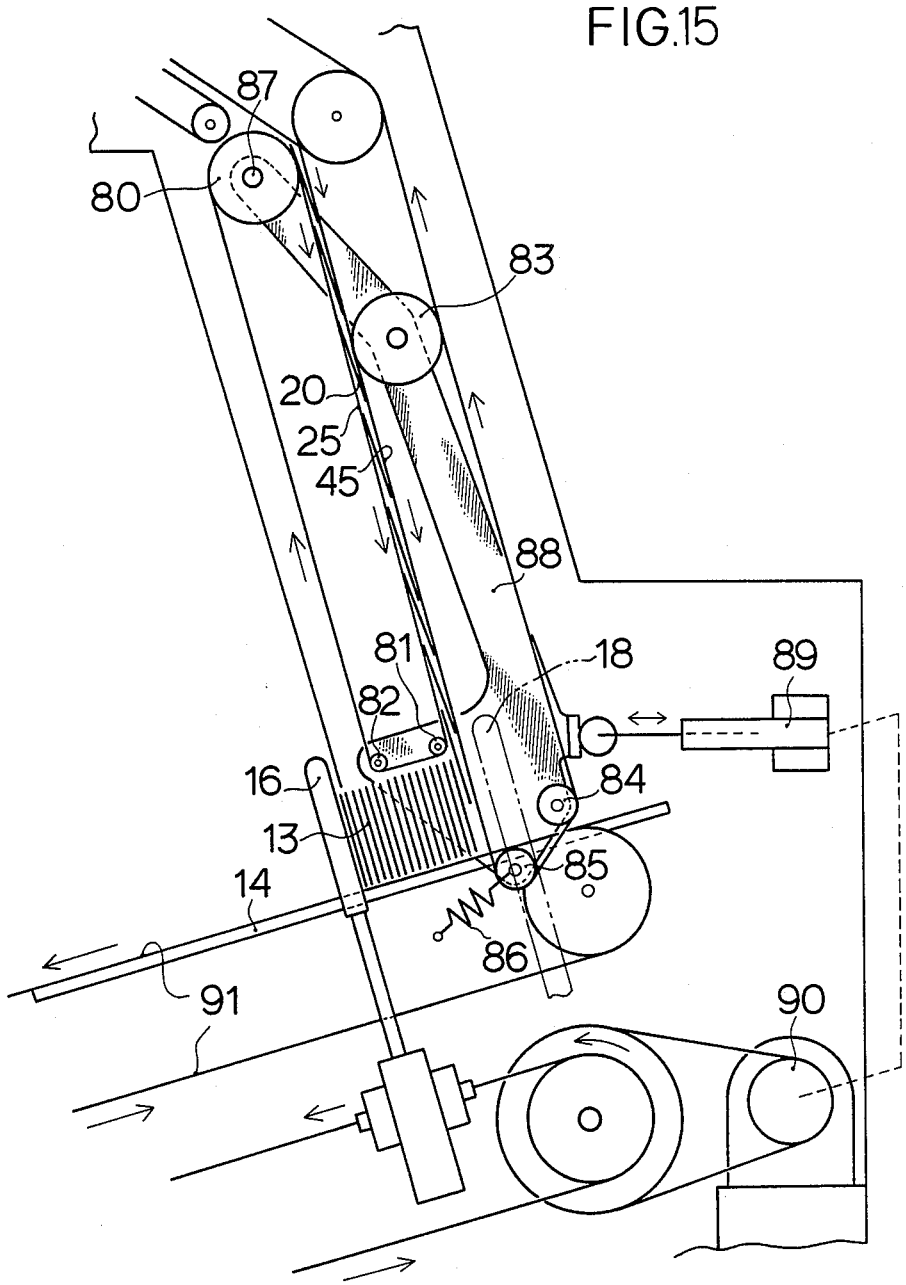
FIG. 15 is an enlarged side view illustrating a first embodiment of the signature stacking mechanism according to the present invention.
Figure 16:
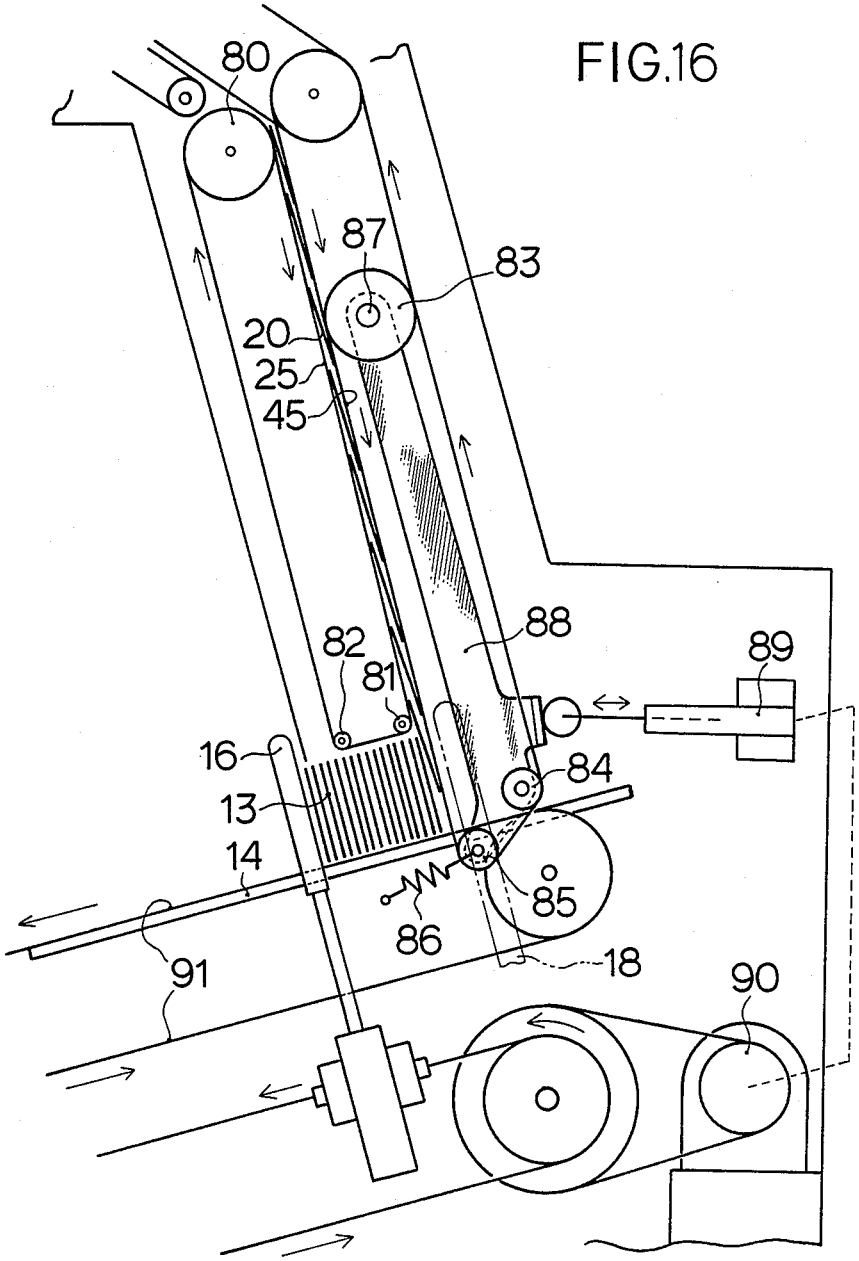
FIG. 16 is an enlarged side view illustrating a second embodiment of the signature stacking mechanism.

Referring next to FIGS. 15 and 16, a stream 20 of signatures completed with printing and folding in which the signatures overlap one another at a predetermined pitch is transported between two endless conveyor belts 25 and 45 which travel adjacent to each other so that the signatures are downwardly loaded onto the guide plate 14 in a direction perpendicular to the plane of the latter.

The conveyor belt 25, which supports the front side of the stream 20 of signatures, is stretched between a relatively large pulley 80 disposed at the upper end and a pair of relatively small pulleys 81 and 82 which are disposed in parallel at the lower end and the belt 25 travels endlessly clockwise as viewed in the figures, whereas, the conveyor belt 45, which supports the rear side of the stream 20 of signatures, is stretched between a relatively large pulley 83 disposed at the upper end and a pair of relatively small pulleys 84 and 85 disposed in parallel at the lower end and the belt 45 travels endlessly counterclockwise as viewed in the figures. The lower end of the belt 45 extends to the lower side of the guide plate 14 to support the rear end of a stack 13 of signatures.

The forward end of the stack 13 of signatures is supported by the first support member, that is, a front retainer 16.

In the above-described arrangement, when a new or following signature is loaded at the rear end of the stack 13 of signatures, the overall length of the stack 13 is increased by an amount corresponding to the thickness of the newly loaded signature. Accordingly, in such case if the front retainer 16 advances a distance corresponding to the thickness of the signature, the stack 13 of signatures can grow smoothly without causing neighboring signatures to be tightly pressed against each other. To achieve this, if the squeezing pressure caused by the newly loaded signature is directly transmitted to the front retainer 16 so as to move the latter, it becomes impossible to satisfactorily move the front retainer 16 as the overall length of the stack 13 of signatures increases, as detailed above in the description of the prior art.

To overcome this problem, in the present invention, both the conveyor belts 25 and 45 (see FIG. 15) or the latter 45 alone (see FIG. 16) is supported by an oscillating member which is able to pivot backward against the force from a spring 86, for example, a lever 88 which has a pivot point 87 at its upper end and a free end at its lower side, and for this purpose, the respective shafts of the pulleys 80, 81, 82, 83, 84 and 85 (see FIG. 15) or the respective shafts of the pulleys 83, 84 and 85 (see FIG. 16) are provided on the lever 88 so that said shafts project from the plane of the latter.

Thus, every time a signature is loaded onto the guide plate 14, the free ends of the conveyor belts 25 and 45 (see FIG. 15) or the free end of the belt 45 (see FIG. 16) is pivotally moved backward about the pivot point 87 by a distance corresponding to the thickness of the loaded signature.

The amount of mechanical backward angular displacement thus obtained is detected by a transducer, e.g., a differential transformer 89, which is linked to the free end of the lever 88, and immediately converted to an electrical amount which is then supplied to a drive means, e.g., a servomotor 90.

The servomotor 90 is provided as a drive source for the front retainer 16; therefore, when supplied with the electrically converted value, the servomotor 90 immediately applies the corresponding mechancial forward displacement amount to the front retainer 16.

As the front retainer 16 mechanically moves forward by a distance corresponding to the thickness of the newly loaded signature, room is provided at the front end of the stack 13 of signatures, thereby allowing the whole of the stack 13 of signatures to move forward, and in this way the room shifts rearward, thus causing the lever 88 to return to its initial position by the force from the spring 86.

The guide plate 14 may be disposed horizontally, but it is preferable that the guide plate 14 be inclined forward so as to assume a slide-like posture in order to enable the stack 13 of signatures to shift forward more easily.

As means for enabling the stack 13 of signatures to shift forward even more easily, the following arrangements may be adopted. Namely, as illustrated, an endless conveyor 91 which is defined by, for example, a nylon chain, is provided along the plane of the guide plate 14 and run at all times independently of the movement of the front retainer 16, or this endless conveyor 91 is driven so as to intermittently advance in response to the advancement of the front retainer 16 by means of a signal delivered from the transducer 89. The former arrangement has the advantage that the operation becomes speedy, while the latter has the advantage that no scuff mark is left on the lower side of the stack 13 of signatures, and both of these arrangements are particularly effective when the thickness of the stack 13 of signatures increases.

As to the transducer for the purpose described above, it is also possible to provide, for example, a potentiometer (not shown) at the pivot point 87 for the lever 88 and supply a value output from the potentiometer to the motor 90.

As to the oscillating member, if the respective shafts of the lower-end small parallel pulleys 84 and 85 (see FIG. 16) or 81, 82, 84 and 85 (see FIG. 15) alone are supported by a slider (not shown) for horizontal movement in order to enable these pulleys to move backward, the mass is reduced, and this allows an improvement in the follow-up capability in a high-speed operation.

According to the present invention, the mechanical backward displacement amount of a conveyor is taken out by means of an oscillating member having a relatively small mass, for example, the lever 88 or the horizontal slider (not shown), while the mechanical backward displacement amount thus taken out is converted to an electrical amount by means of a transducer, for example, the differential transformer 89 or the potentiometer (not shown), and the electrically converted amount is converted to a mechanical forward displacement amount so as to advance the front retainer 16 by a distance corresponding to this displacement amount. Accordingly, the response in a high-speed operation is ensured and quickened. Further, since the guide plate 14 is inclined forward so as to assume a slide-like posture and the conveyor 91 is additionally provided in order to promote the forward shift of the stack 13 of signatures, a new signature can readily be loaded and no pressure is shifted to the inside of the stack 13 of signatures. Accordingly, it becomes possible to stack signatures smoothly and regularly.

Further, the present invention enables the above-described arrangement to be accomplished simply by making use of the existing mechanism and remodeling only a small number of portions thereof without the need to employ a large-scale mechanism. It is, therefore, possible to produce the apparatus at relatively low costs, and failures are not readily generated. In addition, no substantial time and labor are needed to conduct maintenance, inspection and adjustment. Accordingly, the present invention provides a great practical value.

Figure 17:
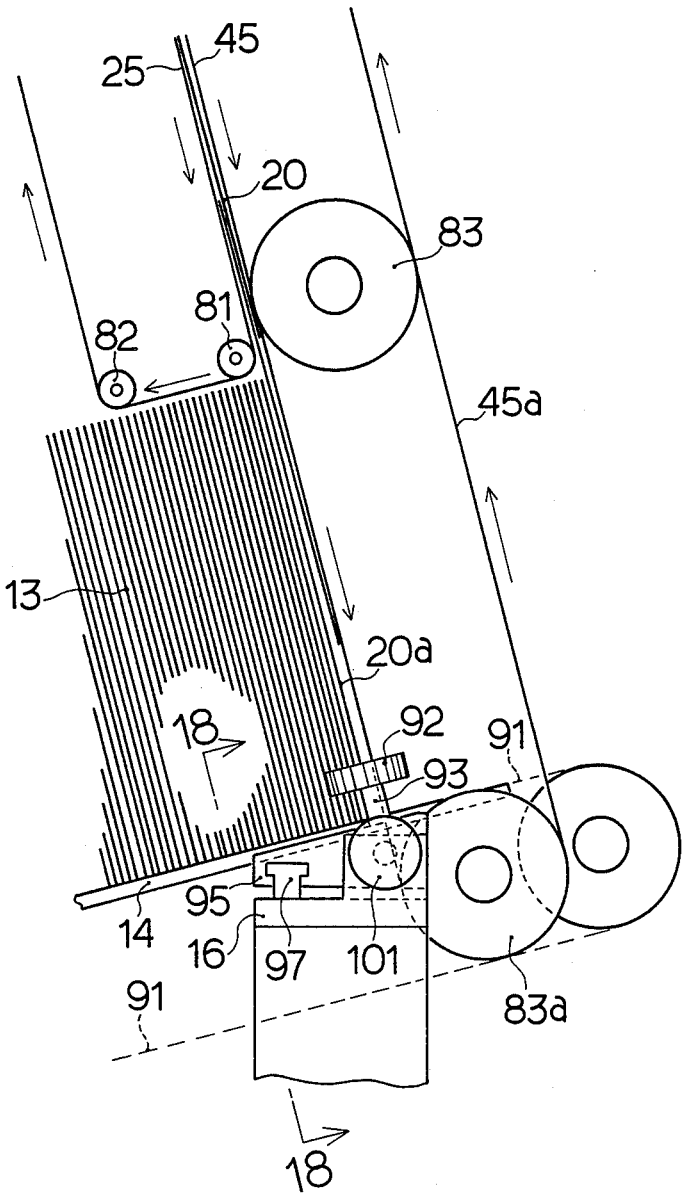
FIG. 17 is an enlarged side view illustrating a first embodiment of an auxiliary mechanism for stacking signatures according to the present invention.

Referring next to FIG. 17, a stream 20 of signatures completed with printing and folding in which the signatures overlap one another at a predetermined pitch is transported between two endless conveyor belts 25 and 45 which travel adjacent to each other.

The conveyor belt 25, which supports the front side of the stream 20 of signatures, is stretched between a pulley (not shown) disposed at the upper end and a pair of relatively small pulleys 81 and 82 which are disposed in parallel at the lower end and the belt 25 travels endlessly clockwise as viewed in the figure, whereas, the conveyor belt 45, which supports the rear side of the stream 20 of signatures, is stretched between a pulley (not shown) disposed at the upper end and a pulley 83 disposed at the lower end and the belt 45 travels endlessly counterclockwise as viewed in the figure. Further, the rear side of the stream 20 of signatures is supported by a third conveyor belt **45*a* which is stretched between the pulley 83 and a pulley 83*a* disposed below it and travels endlessly counterclockwise. In this way, the stream 20 of signatures is downwardly loaded onto a plane 14** in a direction perpendicular to the latter.

It should be noted that signatures may be upwardly loaded onto the plane 14 in a direction perpendicular to the latter. In such case, there is a need to provide a stopper for defining the upper extremity of travel of loaded signatures.

Although in the illustrated embodiment the plane 14 is denoted by a guide plate, it is not necessarily needed to be a visible plate surface and may be defined by two parallel chain conveyors; in such case also, signatures which are loaded thereonto can be stacked horizontally. The reference numeral 13 denotes a stack of signatures which are stacked horizontally on the plane 14 in such a manner that the respective lower ends of the signatures are in exact register with each other.

An endless conveyor for shifting the stack 13 of signatures forwardly, for example, a chain 91, is provided in the longitudinally central portion of the guide plate 14, so that the central portion of the lower end of each signature on the guide plate 14 is in contact with the chain 91 and the signature is thereby advanced by the action of the chain 91. This forward movement of signatures is uniformly caused throughout the stack 13 even at the rearmost signature of the the stack 13, that is, a signature **20*a* which has just been loaded, provided that the central portion of the lower end of the signature is in contact with the chain 91**.

However, the chain 91 cannot be provided at a portion of the lower end of a signature other than the central portion thereof, particularly a portion closer to a corner thereof, since there are variations in width of signatures.

For this reason, there are many cases where corner portions of the lower ends of signatures constituting the stack 13 on the plane 14 are not advanced by the action of the chain 91 but left undesirably; in such cases, the left portions of the signatures obstruct entrance of a signature which is loaded subsequently, so that the subsequent signature is blocked halfway the loading path to become unable to enter anymore. Accordingly, in this case, loading of the signature is ended in a state wherein the lower end portion of the signature is not satisfactorily in contact with the plane 14 and therefore is not in exact register with the lower end portion of the neighboring signature. With this state, no normal stack of signatures can be obtained, and this leads to a trouble in a bookbinding operation carried out a subsequent step.

In order to overcome this problem, according to the present invention, a feed member 92 is provided in such a manner that it is able to come into contact with one side edge portion of the signature **20*a* which has just been loaded and which defines the rear end of the stack 13 of signatures, and a means for driving the feed member 92 in such a manner that the feed member 92 is moved while maintaining the contact with the side edge portion of the signature 20*a* in a direction in which the stack 13 of signatures is advanced, thus enabling the side edge portion of the signature 20*a*** to be advanced simultaneously with the advancement of the central portion of the lower end thereof.

The feed member 92 is adapted to move forward the side edge portion of a signature **20*a* which has just been loaded and which defines the rear end of the stack 13 of signatures, but the feed member 92 may also be adapted to act so as to move forward the respective side edge portions of several signatures which have already been stacked ahead of the signature 20*a***.

Practical examples of the feed member 92 may include a straight toothed pinion (see FIGS. 17 to 19) rotated through a shaft, a toothed endless belt **92*a* (see FIG. 20) which travels between two shafts, a worm-like screw 92*b* (see FIG. 21) rotated through a horizontal shaft, and a rack-like toothed plate 92*c* which repeats advancement, separation, retraction and contact. As a material for these means serving as the feed member 92, it is preferable to employ a non-rigid material, e.g., nylon or rubber, which will not damage the side edges of signatures. Alternatively, a hair- or brush-like material or a file-like friction material may be attached to the surface of the area of the feed member 92** which comes into contact with signatures; in such case also, the same effectiveness can be achieved.

The feed member 92 is driven by rotating the shaft 93 supporting it by a drive system (not shown), and the rotational speed of the feed member 92 is preferably changed in accordance with the rate at which signatures are loaded.

The size of signatures which are stacked on the plane 14 is not the same at all times and there are cases where the size of signatures which are loaded changes, for example, from the size A4 to the size B4 and vice versa. In such cases, there is inevitably a change in the relative position of the side edge portions of signatures due to the difference in terms of the width of signatures. Even when there is no change in the size of signatures, there are cases where there is a considerable change in the quality of paper constituting signatures or in the number of pages defined by each signature. In such cases, it may be preferable to change and adjust the level of pressure with which the feed member 92 comes into contact with side edge portions of signatures.

In order to provide an optimal contact state at all times even in the above-described cases, it is necessary to arrange the mechanism such that the position of the feed member 92 can be moved in the direction of the width of signatures for adjustment of the contact pressure.

There may be a variety of means for adjustably moving the feed member 92. One example of such means is shown in FIGS. 17 and 18, in which are provided a bracket 94 for rotatably supporting the shaft 93 and a slider 95 which is integral with the bracket 94, the slider 95 being movably attached to a guide 97 which is integral with a support plate 96. A bearing 98 is provided so as to project from the outer side of the upper surface of the plate 96, and the neck portion of an adjusting screw 99 is rotatably supported by the bearing 98, while the distal end portion of the adjusting screw 99 is engaged with an internally threaded bore 100 which is provided in the bracket 94.

Accordingly, when a handle 101 which is provided on the proximal end portion of the adjusting screw 99 is turned, the screw 99 is rotated to move the bracket 94 which is in engagement with the screw 99 through the bore 100, and the bracket 94 is thus moved in a direction of movement of the slider 95 mounted on the guide 97. Accordingly, the position of the feed member 92 can be adjusted in the direction of the width of the signature 20*a* by operating the handle 101.

To fix the feed member 92 at an optimal position, a lock mechanism (not shown) is used. The positional adjustment may be effected not only by manually operating the handle 101 but also by activating a motor (not shown), and both may be used in combination.

In some cases, it is only necessary, to obtain satisfactory effectiveness, to provide the apparatus of the present invention at one side edge portion of signatures, and in some other cases, it is preferable to provide a pair of apparatuses at both side edges portions, respectively, in opposing relation to each other. The latter cases may be common in general. However, since the edge of the folded side of a signature has a relatively high degree of stiffness and can readily follow the forward movement of the central portion of the signature, the apparatus of the present invention may be omitted or rested for such side edge portions of signatures.

As has been detailed above, according to the present invention, the side edge portion of the signature 20*a* which has just been loaded and which defines the rear end of the stack 13 of signatures can be advanced by the action of the feed member 92, 92*a*, 92*b*, 92*c* or the like simultaneously with the advancement of the central portion of the signature 20*a* and in the same way as the latter. Accordingly, room for receiving a following signature is provided at the rear end of the stack 13 of signatures, so that the following signature can be smoothly and reliably inserted until it reaches the plane 14 without any fear of the signature being interfered or blocked halfway the loading path.

Further, when it is necessary to alter the contact position of the feed member or the level of contact pressure.thereof due to a change in terms of the width of signatures to be loaded or of the quality of paper therefor, the contact position or the level of contact pressure can speedily and readily be adjusted by a simple and inexpensive mechanism.

On the other hand, any misalignment of lateral edges of loaded signatures can quickly be corrected by the feed operation of the feed member so that the signatures are positioned in an optimal state, thus enabling formation of a satisfactory stack of signatures in which the side edges of the signatures are in exact register with each other.

With the above-described various advantages, a superior stack of signatures which is longer than and superior to the conventional one can be supplied to a bookbinding step.

Figure 24:
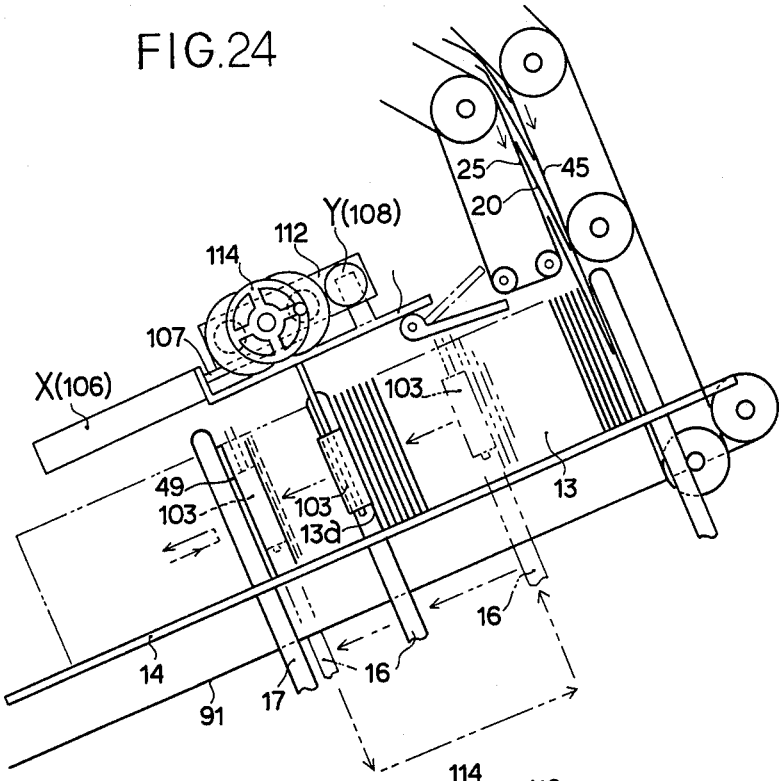
FIG. 24 is a side view of the embodiment shown in FIG. 23.
Figure 23:
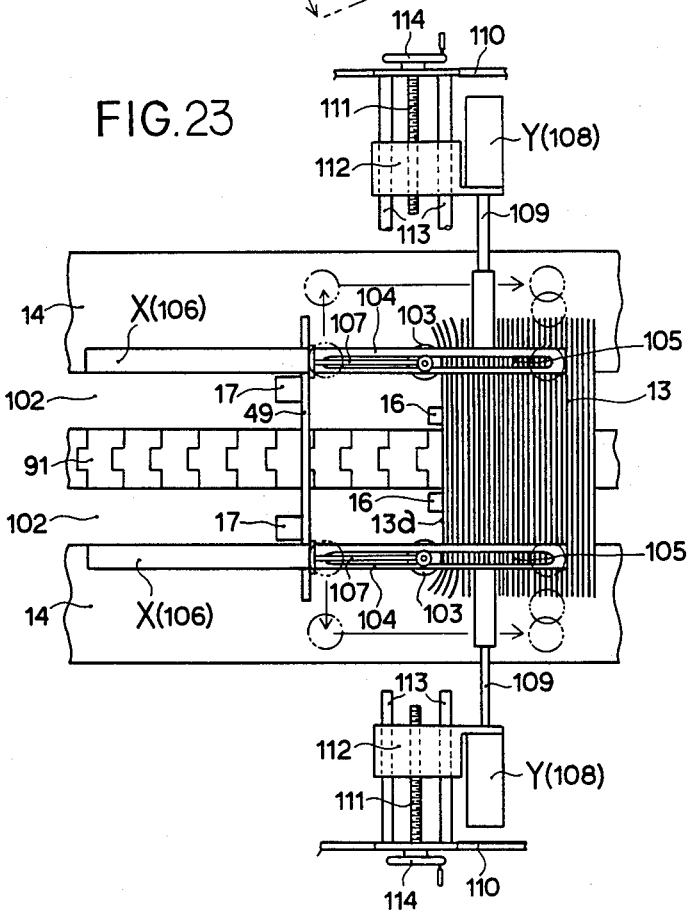
FIG. 23 is a plan view of a first embodiment of a means for attaching a panel to the front end of a stack of signatures according to the present invention.
Figure 25:
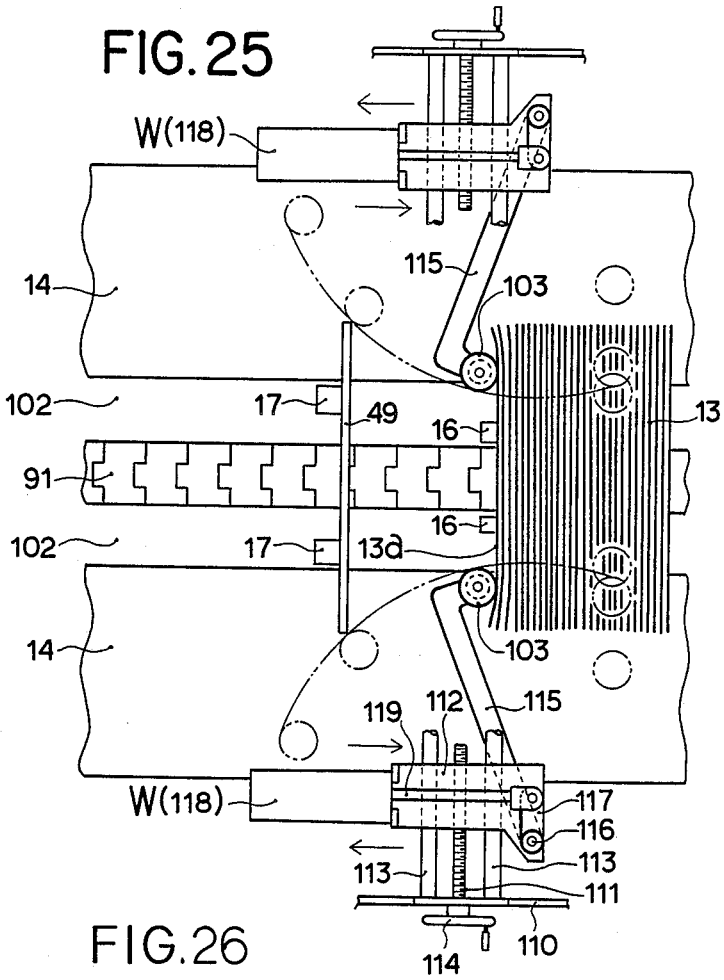
FIG. 25 is a plan view illustrating a second embodiment of the means for attaching a panel to the front end of a stack of signatures.
Figure 26:
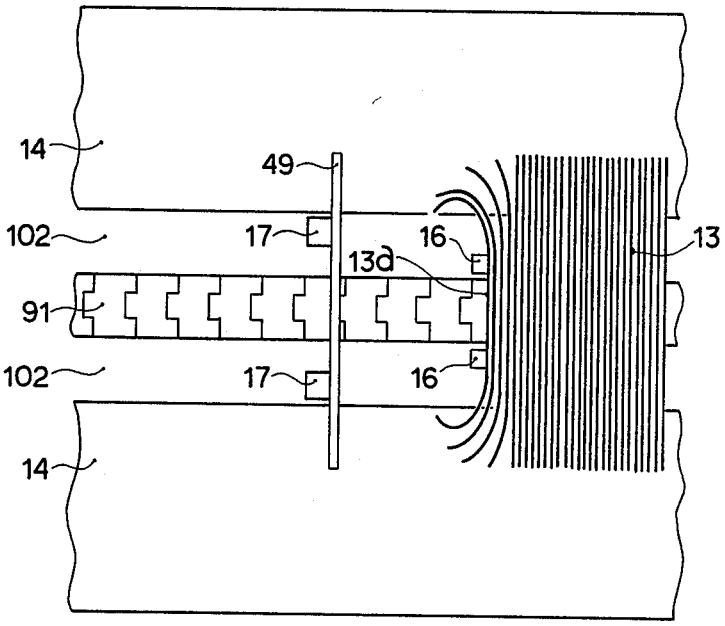
FIG. 26 is a plan view illustrating a forwardly turned-up phenomenon which occurs in the case where no panel is attached to the front end of a stack of signatures.

The apparatus for preventing buckling of the front end of a stack of signatures according to the present invention will be described below with reference to FIGS. 23 to 25, in which FIGS. 23 and 24 show in combination a first embodiment wherein two actuators X and Y are disposed in relation to each other on orthognal coordinate axes, respectively, and FIG. 25 shows a second embodiment wherein a single common actuator W is adapted to sectorially act on a polar coordinate system. The first embodiment will first be explained below.

Referring to FIG. 24, a stream 20 of signatures completed with printing and folding in which the signatures overlap one another at a predetermined pitch is transported between two endless conveyor belts 25 and 45 which travel adjacent to each other so that the signatures are vertically loaded onto the guide plate 14 successively and stacked horizontally thereon to gradually form a stack 13 of signatures.

As shown in FIG. 23, the guide plate 14 has a gap 102 provided in its central portion so as to extend in the longitudinal direction. Further, a conveyor 91 for transporting a stack 13 of signatures is disposed to run in the center of the gap 102, and panel transport members (serving as the above-described second support member) defined by two upstanding rods 17 are disposed in such a manner that the rods 17 extend upward through two left and right gap areas 102, respectively, which are defined by the conveyor 91. A panel 49 is transported by the transport members 17 to a predetermined position halfway the guide path on the guide plate 14 and stopped thereat to await the arrival of the front end 13*a* of the stack 13 of signatures.

On the other hand, the stack 13 of signatures formed on the guide plate 14 is supported at the central portion of its front end 13*a* by temporarily retaining members (serving as the above-described first support member) which are defined by two upstanding rods 16, The rods 16 also upwardly extend through the gap areas 102 as shown in FIG. 24 to temporarily retain the central portion of the front end 13*a* of the stack 13 of signatures and, while doing so, they move on the guide plate 14 leftward as viewed in the figures. When reaching the position where the panel 49 stands by, the upstanding rods 16 lower below the guide plate 14 and move, in this lowered state, rightward as viewed in the figures to their initial positions where they project above the guide plate 14 again when a subsequent stack 13 of signatures is to start to grow so as to temporarily retain the central portion of the front end 13*a* of the stack 13 of signatures.

After the front end of the stack 13 of signatures has been transferred from the temporarily retaining members 16 to the panel 49, the transport members 17 for supporting the panel 49 move leftward as viewed in the figures.

The above is an outline of the known apparatus for stacking signatures.

The apparatus according to the present invention is provided with support members 103 which come into contact with two lateral edge portions, respectively, of the front end 13*a* of the stack 13 of signatures. The support members 103 may be of roller type, plate type, brush type or air nozzle type. Example of a material for the support members 103 include a synthetic resin, a metal, wood, asbestos and sisal. The support membes 103 may be either rigid, elastic or flexible. A pair of right and left support members 103, that is, two support members 103, are generally provided as illustrated. However, since the degree to which an edge portion of a signature is turned up is lower at the folded side than that at the leaf side, the support member 103 for the folded side may be omitted.

Second guide plates 104 are provided above the guide plate 14 so as to extend in the longitudinal direction of the latter, the guide plates 104 being provided with respective slots 105 through which the upper end portions of the support members 103 extend. Air cylinders 106 (corresponding to the actuators X) are provided at the front ends of the second guide plates 104, respectively, and the distal ends of rods 107 of the air cylinders 106 are rigidly secured to the upper ends of the support members 103, respectively.

It is preferable to control the level of pressures produced by the air cylinders 106 so that the support members 103 follow the movement of the temporarily retaining members 16 in such a manner as to enable the lateral edge portions of the front end 13*a* of the stack 13 of signatures to move in such a manner that said edge portions will not project forward beyond the central portion of the front end 13*a*. One example of the pressure control may be such that a pressure reducing valve (not shown) is provided in an air circuit for supplying air to the air cylinders 106 in order to enable adjustment of the level of pressure, thereby allowing prevention of warpage of the front end 13*a* of the stack 13 of signatures and also permitting the support members 103 to move backward while following the advancement of the stack 13 of signatures.

It should be noted that, when there is no load from the stack 13 of signatures, the pressures produced by the air cylinders 106 act to expand the rods 107 in order to automatically return the support members 103 to the right-hand ends of the slots 105.

However, it is necessary to pass the completed stack 13 of signatures along the guide plate 14 before the support members 103 are automatically returned and therefore the support members 103 need to be retracted to the outside of the passage of the stack 13 of signatures. The support members 103 may be retracted either sideward, upward or obliquely upward. In the illustrated embodiment they are retracted sideward.

To retract each support member 103 in a direction perpendicular to the direction of advancement of the stack 13 of signatures, a rod 109 is projected outward from the intermediate portion of the corresponding second guide member 104 and the rod 109 is moved outward by the operation of a solenoid (corresponding to the actuator Y). The solenoid 108 is excited, for example, in response to a excitation command which is issued by detecting with a sensor (not shown) the fact that the support member 103 which is moved backward comes into contact with the panel 49.

When the support members 103 are retracted from the passage space for the stack 13 of signatures by the operation of the solenoids 108, the load of the signatures is removed and therefore the support members 103 are automatically returned to the right-hand ends of the respective slots 105 by the forces from the air cylinders 106 as described above and await the passage of the stack 13 of signatures thereat. When the passage of the stack 13 of signatures is detected by the sensor (not shown), the solenoids 108 are de-energized in response to a detection signal from the sensor, and the support members 103 are advanced into the space for stacking signatures.

It should be noted that the temporarily retaining members 16 are also adapted to lower below the guide plate 14 after coming into contact with the panel 49 and rise above the guide plate 14 at the position where the support members 103 are advanced, as shown in FIG. 24.

Since there are variations in the width of signatures to be sacked according to the kind thereof, it is necessary to provide a mechanism for variably adjusting the position of contact between the support members 103 and the stack 13 of signatures in order to cope with a change in width of signatures.

To meet with the requirement, an externally threaded rod 111 is mounted on a machine frame 110 in such a manner that the rod 111 is axially movable and rotatable back and forth, and an internally threaded bore is provided in a slide block 112 which is integral with the corresponding solenoid 108, the rod 111 being engaged with the bore. Further, guide shafts 113 are provided so as to project from the machine frame 110 in order to prevent the rotation of the slide block 112 and allow it to move only in the axial direction, and the slider block 112 is thus guided along the shafts 113. Accordingly, when a handle 114 which is attached to the outer end of the externally threaded rod 111 is turned, the slide block 112 is moved only axially, and this movement is transmitted to the corresponding support member 103 through the solenoid 108, the rod 109 thereof and the second guide member 104, thus enabling adjustment of the position of the support member 103 where it comes into contact with the front end 13*a* of the stack 13 of signatures.

It should be noted that the handle 114 may readily be arranged so as to be operated manually, automatically or selectively by a manual or automatic operation, and a means for locking the adjusted contact position can readily be provided if desired although illustration thereof is omitted.

Points in which the second embodiment differs from the above-described first embodiment will be described below in detail. Each support member 103 is attached to the free end of an oscillating lever 115 the proximal end of which is pivotally supported through a shaft 116 by one end of the slider block 112. The free end portion of an arm 117 which probjects from the shaft 116 is linked to the distal end portion of a rod 119, and this rod 119 is actuated by an air cylinder 118 (corresponding to the actuator W).

Accordingly, the support member 103 is sectorially moved about the shaft 116 by the action of a single common actuator 118. Therefore, although the contact position of the support member 103 is displaced slightly as the front end 13*a* of the stack 13 of signatures moves, it is possible to satisfactorily prevent the front end 13*a* of the stack 13 from being turned up, and in addition, when coming into contact with the panel 49, the support member 103 is automatically retracted to the outside of the passage of the stack 13 of signatures. On the other hand, since signatures are continued to be stacked thereafter, the support member 103 is drawn leftward as viewed in the figure by the action of the air cylinder 118 so that the support member 103 will not obstruct stacking of signatures. Thus, the support member 103 is sufficiently retracted outward of the signature stacking space and, in this position, the support member 103 awaits the passage of the stack 13 of signatures. When the stack 13 of signatures has been passed and a subsequent stack 13 of signatures is started to grow, the rod 119 is projected rightward as viewed in the figure by the action of the air cylinder 118 to thereby return the support member 103 so as to come into contact with the front end 13*a* of the stack 13 of signatures.

In this embodiment also, in the same manner as in the above-described first embodiment, the position of the support member 103 can be altered for adjustment by moving the slide block 112 in order to cope with a change in the width of signatures.

In the section where the central portion of the front end 13*a* of the stack 13 of signatures is supported by the temporarily retaining members 16, turning up of the front end 13*a*, which occurs in the conventional apparatus, is prevented by the provision of the support members 103 according to the present invention. Accordingly, when the panel 49 is attached to the front end 13*a*, it is possible to eliminate buckling of a signature which defines the front end 13*a* of the stack 13 or several signatures near the front end 13*a*, and it is therefore possible to supply a completely satisfactory stack 13 of signatures to a subsequent bookbinding step, which means that the present invention greatly contributes to improvements in the bookbinding operation efficiency and the quality of books or the like.

Since the contact positions of the support members 103 are made adjustable in correspondence with the width of signatures to be stacked, the present invention has the general-purpose property which enables it to be used in any kind of signature stacking apparatus and therefore provides a considerably high practical value.

The following is a description of the apparatus for attaching a panel to the rear end 13*b* of a stack 13 of signatures.

Figure 27:
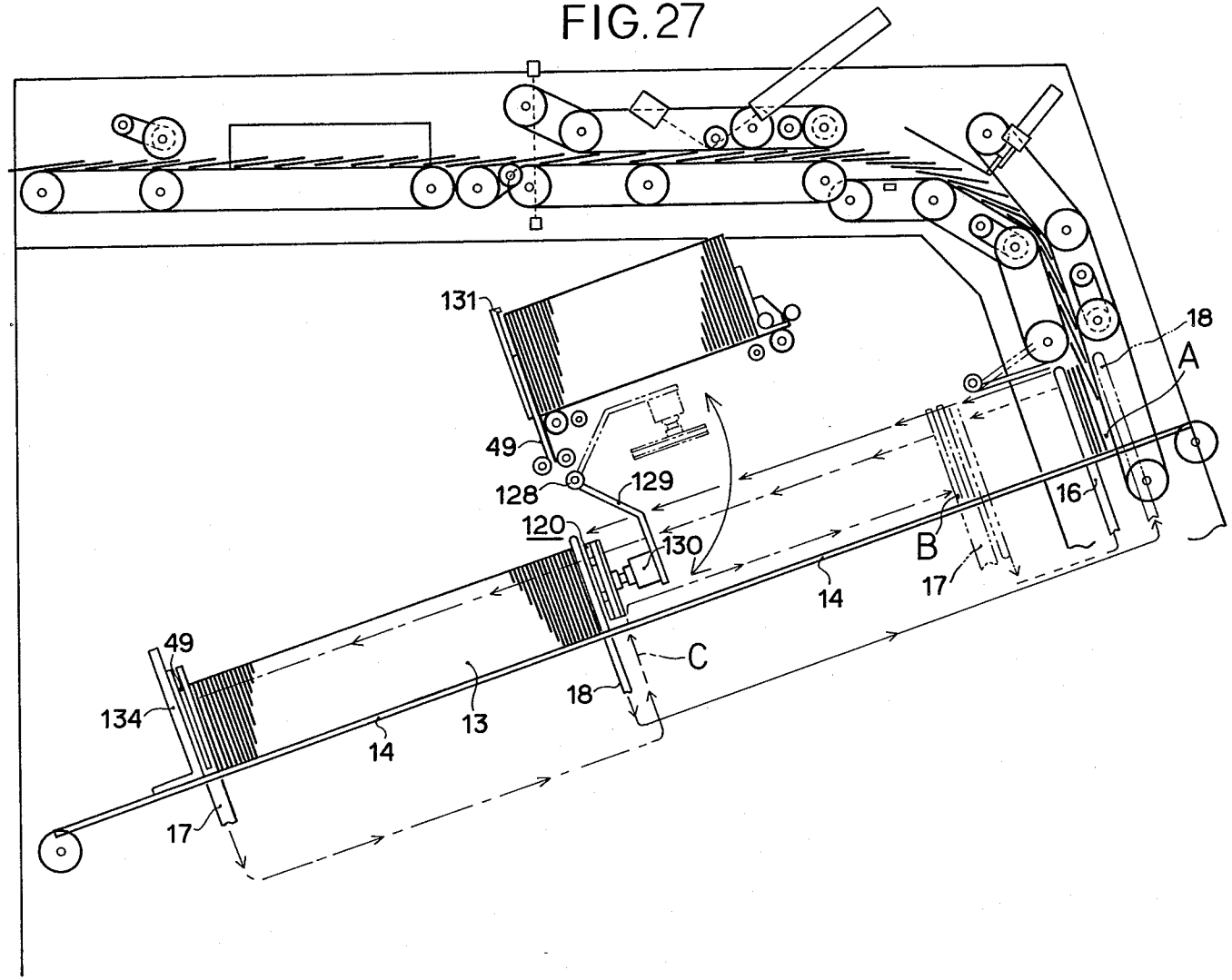
FIG. 27 is a side view illustrating a first embodiment of a means for attaching a panel to the rear end of a stack of signatures according to the present invention in relation to the general arrangement of the signature stacking mechanism.

Referring to FIG. 27, each of the signatures which have been completed with printing and folding is loaded onto the uppermost portion of a slide-like guide plate 14 from the upper side thereof. The foremost portion of the stack 13 of signatures is supported by a first support member 16 from the signature loading position A to the stand-by position for a second support member 17 and then supported by the second support member 17 from the stand-by position B to the unloading position (shown by the solid line in FIG. 27) for the stack 13 of signatures. During formation of the stack 13 of signatures, the rear end 13*b* of the stack 13, which is the subject of the present invention, is pushed by a third support member 18 throughout the signature stacking space, that is, from the uppermost position A of the guide plate 14 to the lowermost end of the unloading position.

Figure 28:
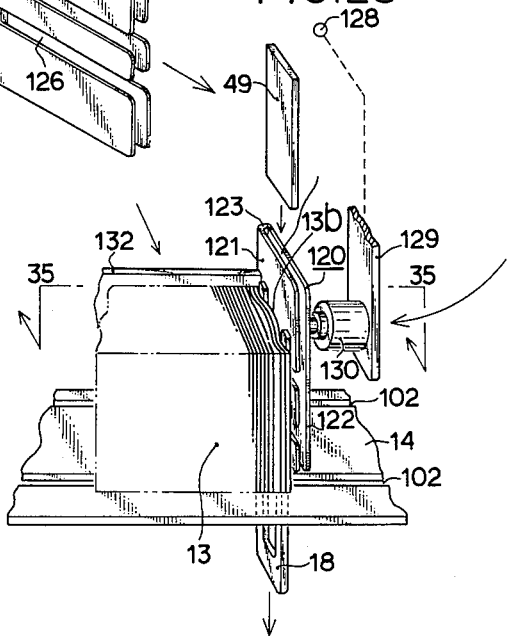
FIG. 28 is a perspective view of an essential part of the embodiment shown in FIG. 27.

The guide plate 14 is, as shown in FIG. 28, provided with two parallel slits 101 which extend longitudinally of the guide plate 14, and each of the support members extends upwardly through the slits 101 so as to project above the guide plate 14. Accordingly, the portion of each support member which projects above the guide plate 14 is defined by substantially two bar members.

The bar portion of the second support member 17 which projects above the guide plate 14 is formed with a pair of front and rear prongs as shown in FIG. 27, so that a panel 49 can be supplied into the gap or slot defined between the two prongs at a position halfway the return path section of the moving path for the second support member 17 shown by the one-dot chain line arrows, that is, at the position C where the second support member 17 in a non-loaded state projects above the guide plate 14. Thus, the panel 49 is attached to the front end of the stack 13 of the signatures from the beginning, and when the second support member 17 is retracted to the lower side of the guide plate 14 at the final position of the stack supporting section, the panel 49 is left alone on the guide plate 14 and immediately supported by a paper guide 134 and, in this way, the panel 49 can readily be attached to the front end of the stack 13.

As to the attachment of a panel 49 to the rear end 13*b* of the stack 13 of signatures, which is the subject of the present invention, however, it is impossible due to the positional relationship to supply a panel 49 to the third support member 18 at a position halfway the return path section of the moving path therefor shown by the solid line arrows (i.e., when the third support member 18 is non-loaded), and the support member 18 must be supplied with the panel 49 at the final position of the stack supporting section. Accordingly, the rear end 13*b* of the stack 13 of signatures is pushed all the way to the final position only by the two bar members which define the portion of the third support member 18 which projects above the guide plate 14, and this causes the portion of the rear end 13*b* which is between the two bar members to bulge rearwardly. As a result, this rearwardly bulging portion may be damaged by the conventional panel attaching means, as described above.

Therefore, in the present invention, a panel receiving intermediary box 120 such as that shown in each of the embodiments shown in FIGS. 30 to 35 is employed to attach a panel 49 to the rear end 13*b* of the stack 13 of signatures.

The box 120 consists of a pair of plates 121 and 122 and a spacer 123 which interconnects these plates at one side edge of each of them. A panel 49 is received in the space defined between the pair of plates 121 and 122 retained by the spacer 123. The spacer 123 is provided at the rearward edge of the combination of the plates 121 and 122 in all the embodiments except for that shown in FIG. 30 in which the spacer 123 is provided at the forward edge.

Figure 30:
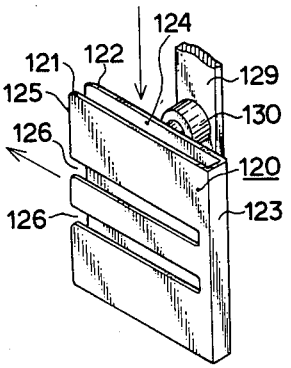
FIGS. 29 to 34 respectively illustrating various embodiments of the means for attaching a panel to the rear end of a stack of signatures.

A panel insertion port 124 is opened along the upper edge of the box 120, and a panel discharge port 125 is provided at the forward edge in all the embodiments except for that shown in FIG. 30 in which the port 125 is provided at the rearward edge.

Linear notches 126 for raking out a panel 49 are opened to the discharge port 125. Accordingly, in all the embodiments except for that shown in FIG. 30, a panel 49 is inserted into the box 120 from the upper side thereof and is discharged to the front side, whereas, in the embodiment shown in FIG. 30, a panel 49 is inserted into the box 120 from the upper side thereof and discharged to the rear side.

Figure 29:
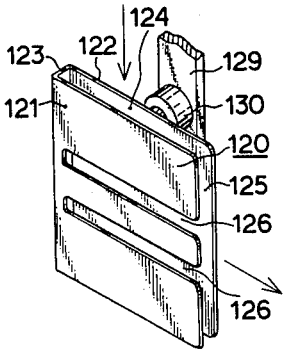
Figure 32:
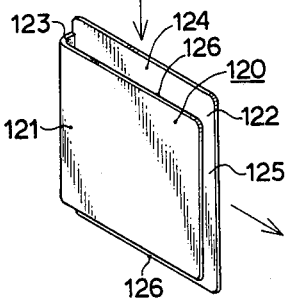
Figure 31:
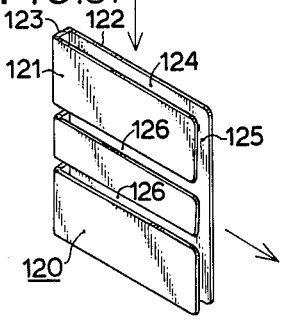
Figure 34:
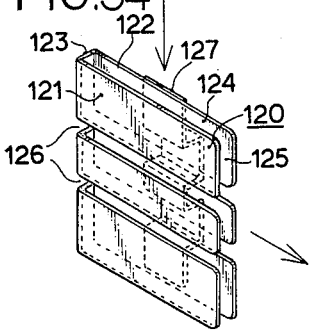
Figure 33:
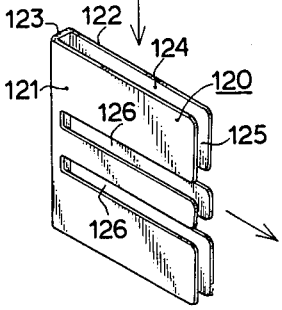
Figure 35:
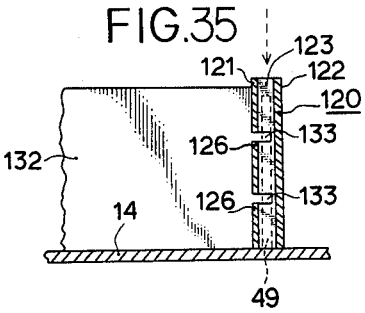
FIG. 35 is a vertical sectional view taken along the line 35—35 of FIG. 28.

The notches 126 are generally provided in the forward plate 121 but may be provided in both the plates 121 and 122 as shown in FIGS. 34 and 35. Further, the notches 126 may be provided in the plate so as to extend from the intermediate portion thereof as in the cases of the embodiments shown in FIGS. 29, 30 and 33 or may be provided so as to reach the spacer 123 as in the cases of the embodiments shown in FIGS. 31, 32 and 34. In addition, the notches 126 may be provided so as to extend along the upper and lower side edges, respectively, of the forward plate 121 as shown in FIG. 32. It should be noted that, when both the plates 121 and 122 are divided into three sections, these three sections are supported by a connecting member 127 as shown in FIG. 34.

The box 120 having the above-described arrangement is attached to the rear end 13*b* of a stack 13 of signatures in a direction in which the former faces the latter by a means described below.

A pivot shaft 128 is disposed at a position above the level at which the stack 13 of signatures passes on the guide plate 14, and an arm 129 is projected from the shaft 128. The rear side of the box 120 is secured through a spacing adjusting member 130 to the free end portion of the arm 129.

Accordingly, as shown in FIG. 27, the box 120 is able to oscillate between two positions, that is, an inoperative position (see the two-dot chain line position) which is outside the passage of the stack 13 of signatures and an operative position (see the solid line position) at which the box 120 comes into contact with the rear end 13*b* of the stack 13.

To supply a panel 49 into the box 120, as shown in FIG. 27, a claw 131 is first activated to engage and push downward the upper end face of a panel 49. The panel 49 is thus inserted into the space in the box 120 while being guided by a pair of rubber rollers.

The following is a description of the arrangement of a means for removing one plate 121 of the box 120 from the area between the rear end 13*b* of the stack 13 of signatures and the panel 49.

A push member 132 is provided in order to move the whole of the stack 13 of signatures at a stroke in the direction of width of the signatures, and, as shown in FIG. 35, projections 133 for raking out a panel 49 are provided at the end of the push member 132, the projections 133 being disposed so as to extend into the innermost portions of the linear notches 126 in advance. In consequence, as the push member 132 moves toward this side as viewed in the figure, the projections 133 which are integral therewith are also moved along the linear notches 126. Accordingly, the panel 49 within the box 120 is raked out from the discharge port 122 of the box 120 at the same time as the stack 13 of signatures is moved, resulting in the box 120 being left alone.

In this way, the panel 49 is attached to the rear end 13*b* of the stack 13 of signatures.

Since the box 120 shown in FIG. 30 has the spacer 123 provided at the forward edge thereof, the push member 132 is moved from the forward end toward the rear end thereof in this embodiment.

It should be noted that the third support member 18 is retracted to the lower side of the guide plate 14 before the push member 132 starts to move so that the support member 18 will not interfere with the advancement of the push member 132.

According to the present invention, in order to cope with the special circumstance that the rear end 13*b* of the stack 13 of signatures bulges rearwardly, the panel receiving intermediary box 120 is attached to the rear end 13*b* in a direction in which the former faces the latter, that is, in a direction in which the rearwardly bulging portion of the rear end 13*b* is pushed back by the box 120. It is therefore possible to eliminate the conventional problem that the rear end 13*b* of the stack 13 may be damaged.

Further, the present invention makes use of the transportation of the stack 13 of signatures in the widthwise direction as a means for directly attaching a panel 49 inserted into the box 120 to the rear end 13*b* of the stack 13 in such a manner that the panel 49 within the box 120 is also moved in synchronism with the widthwise movement of the stack 13 so that the box 120 is left alone in a direction parallel to the plane of the rear end 13*b* of the stack 13. Accordingly, it becomes possible to attach the panel 49 to the rear end 13*b* smoothly, simply, inexpensively and easily.

Since the present invention enables the panel 49 to be reliably attached to the rear end 13*b* of the stack 13 at a normal position, there is no fear of the signatures being disordered when being bound, so that the operation carried out in a subsequent bookbinding step can be effected without any hitch or delay. Accordingly, the present invention is considerably effective in saving resources and reducing labor.

What is claimed is:

1. An apparatus for stacking signatures comprising:

a guide plate for stacking signatures which has a predetermined angle of inclination;

a conveyor for successively loading signatures onto the starting end of said guide plate from the upper side of the latter;

a first support member gradually lowering through a section from the signature loading position to an intermediary position while supporting the foremost end of a stack of signatures which are being stacked on said guide plate;

a second support member moving through a section from said intermediary position to an unloading position while supporting, in place of said first support member, the foremost end of said stack which has been transported to said intermediary position while being supported by said first support member; and a third support member moving through the entire section from said loading position to said unloading position while supporting the rearmost end of the stack of signatures loaded onto said guide plate.

2. An apparatus for stacking signatures comprising:

a guide plate for stacking signatures which has a predetermined angle of inclination;

a conveyor for successively loading signatures onto the starting end of said guide plate from the upper side of the latter;

a first support member gradually lowering through a section from the signature loading position to an intermediary position while supporting the foremost end of a stack of signatures which are being stacked on said guide plate;

a second support member moving through a section from said intermediary position to an unloading position while supporting, in place of said first support member, the foremost end of said stack which has been transported to said intermediary position while being supported by said first support member;

a third support member moving through the entire section from said loading position to said unloading position while supporting the rearmost end of the stack of signatures loaded onto said guide plate; and an oscillating plate for correcting any irregularity in alignment of the upper end edges of signatures, said oscillating plate being provided above said guide plate and at a position which is spaced apart from the starting end of said guide plate at a distance corresponding to the length of the signatures.

3. An apparatus for stacking signatures comprising:

a guide plate for stacking signatures which has a predetermined angle of inclination;

a conveyor for successively loading signatures onto the starting end of said guide plate from the upper side of the latter;

a first support member gradually lowering through a section from the signature loading position to an intermediary position while supporting the foremost end of a stack of signatures which are being stacked on said guide plate;

a second support member moving through a section from said intermediary position to an unloading position while supporting, in place of said first support member, the foremost end of said stack which has been transported to said intermediary position while being supported by said first support member;

a third support member moving through the entire section from said loading position to said unloading position while supporting the rearmost end of the stack of signatures loaded onto said guide plate; and means for correcting interruption of a stream of signatures, said means including a photoelectric conversion type detector involving a beam of light crossing said conveyor, a vertically movable conveyor-carrying pulley disposed immediately before said detector and adapted to push up the signature loading path when said light beam is detected by said detector and to return to its initial position when said light beam is intercepted, and downstream conveyor control means which are suspended all together when said light beam is detected by said detector and which are restarted when said light beam is intercepted.

4. An apparatus for stacking signatures comprising:

a guide plate for stacking signatures which has a predetermined angle of inclination;

a conveyor for successively loading signatures onto the starting end of said guide plate from the upper side of the latter;

a first support member gradually lowering through a section from the signature loading position to an intermediary position while supporting the foremost end of a stack of signatures which are being stacked on said guide plate;

a second support member moving through a section from said intermediary position to an unloading position while supporting, in place of said first support member, the foremost end of said stack which has been transported to said intermediary position while being supported by said first support member;

a third support member moving through the entire section from said loading position to said unloading position while supporting the rearmost end of the stack of signatures loaded onto said guide plate; and a signature stream dividing mechanism including a conveyor intermediating pulley provided at a point of bending of said conveyor from a horizontal section to an obliquely downward section, a dividing plate provided so as to be able to extend obliquely downward into a gap between the leading end edge of a signature and the upper surface of a preceding signature, said gap being produced when said leading end edge of the former signature is separated from the upper surface of the latter signature at the position of said pulley, an accumulating plate provided above said intermediating pulley, and a succeeding signature stream lifting member provided immediately before and below said intermediating pulley.

5. An apparatus for stacking signatures comprising:

a guide plate for stacking signatures which has a predetermined angle of inclination;

a conveyor for successively loading signatures onto the starting end of said guide plate from the upper side of the latter;

a first support member gradually lowering through a section from the signature loading position to an intermediary position while supporting the foremost end of a stack of signatures which are being stacked on said guide plate;

a second support member moving through a section from said intermediary position to an unloading position while supporting, in place of said first support member, the foremost end of said stack which has been transported to said intermediary position while being supported by said first support member;

a third support member moving through the entire section from said loading position to said unloading position while supporting the rearmost end of the stack of signatures loaded onto said guide plate; and panel supply means including a mechanism for supplying panels one by one to a panel supply position from a position directly thereabove, said panel supply position being defined by that position in the signature stack unloading position on said guide plate which is coincident with the rearmost end of the completed stack of signatures, a front panel insertion notch the upper end of which is open and which is provided in said second support member, a rear panel insertion auxiliary plate which is able to lower to the panel supply position on said guide plate, and a supply means arranged such that the front panel is inserted into said notch in said second support member moved to and stopped at said panel supply position and said panel is drawn out of said notch by retracting said second support member to the outside of said guide plate at the signature stack unloading position and thereby brought into contact with the front end of the stack of signatures, while the rear panel is brought into contact with the rear end of the stack of signatures by retracting said third support member to the outside of said guide plate.

6. An apparatus for stacking signatures comprising:

a guide plate for stacking signatures which has a predetermined angle of inclination;

a conveyor for successively loading signatures onto the starting end of said guide plate from the upper side of the latter;

a first support member gradually lowering through a section from the signature loading position to an intermediary position while supporting the foremost end of a stack of signatures which are being stacked on said guide plate;

a second support member moving through a section from said intermediary position to an unloading position while supporting, in place of said first support member, the foremost end of said stack which has been transported to said intermediary position while being supported by said first support member;

a third support member moving through the entire section from said loading position to said unloading position while supporting the rearmost end of the stack of signatures loaded onto said guide plate;

panel supply means including a mechanism for supplying panels one by one to a panel supply position from a position directly thereabove, said panel supply position being defined by that position in the signature stack unloading position on said guide plate which is coincident with the rearmost end of the completed stack of signatures, a front panel insertion notch the upper end of which is open and which is provided in said second support member, a rear panel insertion auxiliary plate which is able to lower to the panel supply position on said guide plate, and a supply means arranged such that the front panel is inserted into said notch in said second support member moved to and stopped at said panel supply position and said panel is drawn out of said notch by retracting said second support member to the outside of said guide plate at the signature stack unloading position and thereby brought into contact with the front end of the stack of signatures, while the rear panel is brought into contact with the rear end of the stack of signatures by retracting said third support member to the outside of said guide plate;

a pusher plate for unloading the completed stack of signatures from a position to the side of the signature stack unloading position on said guide plate to a position directly below a banding arch;

a compressing mechanism for longitudinally compressing the stack of signatures directly below said arch; and a binding machine which bands the compressed stack of signatures.

7. An apparatus for stacking signatures comprising:

a guide plate onto which signatures are vertically loaded one by one from a stream of signatures transported in such a manner that the signatures overlap one another at a predetermined pitch and on which the loaded signatures are stacked horizontally;

a front retainer for supporting the front end of the stack of signatures;

a pair of conveyors adapted to sandwich a succeeding signature from the front and rear sides thereof and load it onto said guide plate in the sandwiched state along the rear end of the stack of signatures;

an oscillating member supporting either one or both of said conveyors so as to be movable backward againt force;

a transducer for converting an amount of mechanical backward movement of either one or both of said conveyors into an electrical amount; and a drive means which is supplied with the electrically converted value and transmits an amount of mechanical forward movement corresponding thereto to said front retainer.

8. An apparatus according to claim 7, wherein said guide plate is installed so as to assume a slide-like forward slanting posture, thus causing the stack of signatures on said guide plate to move forward.

9. An apparatus according to claim 7, further comprising a conveyor which travels forward along the plane of said guide plate, thus causing the stack of signatures on said guide plate to move forward.

10. An apparatus according to claim 7, wherein said oscillating member is defined by a lever having a support point at its upper end.

11. An apparatus according to claim 7, wherein said oscillating member is defined by a horizontal slider which supports only shafts for pulleys disposed at the lower end of either one or both of said conveyors.

12. An apparatus according to claim 7, wherein only one of said conveyors which supports the rear side of the stream of signatures is supported by said oscillating member.

13. An apparatus according to claim 7, wherein both of said conveyors are supported by said oscillating member.

14. An apparatus according to claim 7, wherein said transducer is defined by a differential transformer.

15. An apparatus according to claim 7, wherein said transducer is defined by a potentiometer.

16. An apparatus according to claim 7, wherein said drive means is defined by a motor.

17. An apparatus according to claim 16, wherein said motor is a servomotor.

18. In a signature stacking apparatus including:

a guide plate disposed so that signatures are vertically loaded thereonto one by one and stacked thereon horizontally;

a panel which stands by at a predetermined halfway position on said guide plate in order to support the whole of the front end of a stack of signatures formed on said guide plate; and a temporarily retaining member adapted to move while supporting the central portion of the front end of said stack until the front end of said stack reaches the panel stand-by position, an apparatus for preventing buckling of the front end of said stack of signatures, comprising:

at least one support member provided so as to move while being in contact with one lateral edge portion of the front end of said stack during the time when the central portion of the front end of said stack is being supported by said temporarily retaining member;

biasing means for applying a force counter to the direction of advancement of said stack to said support member; and advancing and retracting means adapted to retract said support member to the outside of the signature stacking space at a position where supporting effected by said support member ends and to advance said support member at a position where supporting by said support member starts.

19. In a signature stacking apparatus including:

a guide plate disposed so that signatures are vertically loaded thereonto one by one and stacked thereon horizontally;

a panel which stands by at a predetermined halfway position on said guide plate in order to support the whole of the front end of a stack of signatures formed on said guide plate; and a temporarily retaining member adapted to move while supporting the central portion of the front end of said stack until the front end of said stack reaches the panel stand-by position, an apparatus for preventing buckling of the front end of said stack of signatures, comprising:

at least one support member provided so as to move while being in contact with one lateral edge portion of the front end of said stack during the time when the central portion of the front end of said stack is being supported by said temporarily retaining member;

biasing means for applying a force counter to the direction of advancement of said stack to said support member;

advancing and retracting means adapted to retract said support member to the outside of the signature stacking space at a position where supporting effected by said support member ends and to advance said support member at a position where supporting by said support member starts; and a contact position variable adjusting mechanism which enables the contact position of said support member to move in a direction perpendicular to the direction of advancement of said stack of signatures.

20. An apparatus according to either one of claims 18 and 19, wherein there are a pair of support members which are provided so as to come into contact with two lateral edge portions, respectively, of the front end of said stack of signatures.

21. An apparatus according to either one of claims 18 and 19, wherein said biasing means and said advancing and retracting means are arranged so as to constitute either an orthogonal coordinate system or an oblique coordinate system and respectively activated by two independent actuators.

22. An apparatus according to either one of claims 18 and 19, wherein said biasing means and said advancing and retracting means are arranged so as to constitute a polar coordinate system and activated by a single common actuator.

* * * * *